US005625441A

United States Patent [19]

Sugiyama et al.

[11] Patent Number: 5,625,441

[45] Date of Patent: Apr. 29, 1997

[54] DEVELOPING DEVICE FOR AN IMAGE FORMING APPARATUS

[75] Inventors: Toshihiro Sugiyama, Atsugi; Kazuhiro Yuasa, Zama; Shuichi Endoh, Isehara; Iwao Matsumae, Tokyo; Yoshiaki Tanaka, Kawasaki; Hiroshi Hosokawa, Yokohama; Mugijiroh Uno, Isehara; Hiroshi Saitoh, Ayase; Eiji Takenaka, Isehara; Tetsuo Yamanaka, Tokyo; Eisaku Murakami, Hiratsuka; Satoru Komatsubara, Atsugi, all of Japan

[73] Assignee: Ricoh Company, Ltd., Tokyo, Japan

[21] Appl. No.: 633,453

[22] Filed: Apr. 17, 1996

Related U.S. Application Data

[62] Division of Ser. No. 438,542, May 10, 1995.

[30] Foreign Application Priority Data

| | | | |
|---|---|---|---|
| May 12, 1994 | [JP] | Japan | 6-98707 |
| Jun. 6, 1994 | [JP] | Japan | 6-123877 |
| Jun. 6, 1994 | [JP] | Japan | 6-123880 |
| Jun. 10, 1994 | [JP] | Japan | 6-129006 |
| Jun. 30, 1994 | [JP] | Japan | 6-170429 |
| Jul. 14, 1994 | [JP] | Japan | 6-184158 |

[51] Int. Cl.[6] ..... G03G 15/08

[52] U.S. Cl. ..... 399/272

[58] Field of Search ..... 355/251, 253, 355/259, 245; 118/653, 657

[56] References Cited

U.S. PATENT DOCUMENTS 5,532,804 2/1996 Hirata et al. ..... 355/251

*Primary Examiner*—Joan H. Pendegrass
*Assistant Examiner*—Quana Grainger
*Attorney, Agent, or Firm*—Oblon, Spivak, McClelland, Maier & Neustadt, P.C.

[57] ABSTRACT

In an image forming apparatus, a developing device operable with toner or single component type developer has a hard first developing roller and a soft second developing roller. Fine magnetic N-S poles are formed on the periphery of the first roller. The second roller conveys the toner, electrostatically transferred thereto from the first roller, to an image carrier. The device frees a toner image from deterioration due to toner particles charged to a polarity opposite to an expected polarity. The toner forms a uniform thin layer on the first roller and is uniformly charged. Toner for use with this type of developing device is also disclosed.

9 Claims, 21 Drawing Sheets

FIG. 3
PRIOR ART
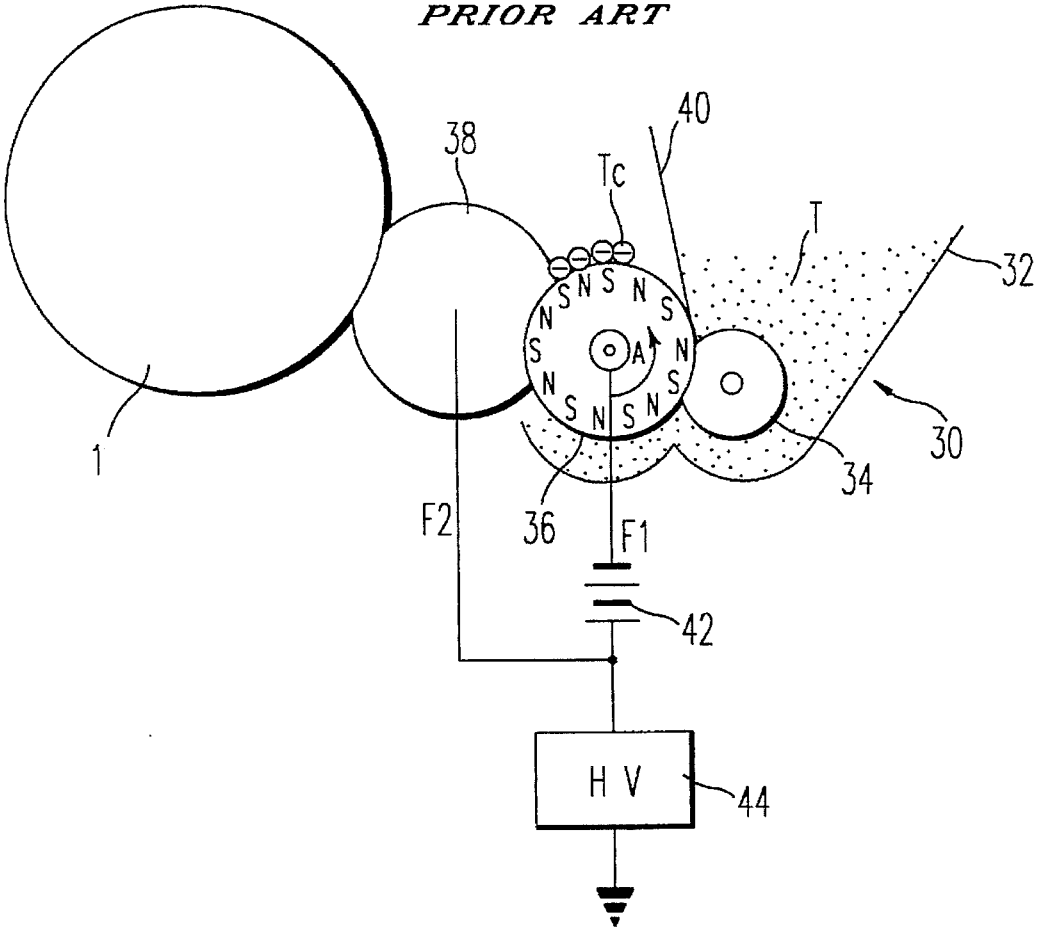
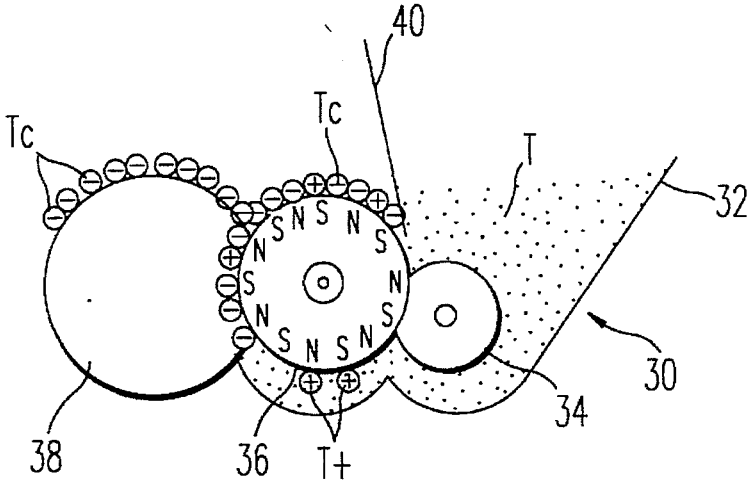
FIG. 4
PRIOR ART

DEVELOPING DEVICE FOR AN IMAGE FORMING APPARATUS

This is a division of application Ser. No. 08/438,542 filed on May 10, 1995.

BACKGROUND OF THE INVENTION

The present invention relates to a developing device for an image forming apparatus and having a hard first developing roller or first conveying means formed with fine magnetic N-S poles on the periphery thereof, and a soft second developing roller or second conveying means for conveying toner, or single component type developer, electrostatically transferred from the first roller to an image carrier.

Generally, in a copier, facsimile apparatus, laser printer or similar electrophotographic image forming apparatus, a developing device is operable with one of a single component type developer, or toner, and a two component type developer or toner and carrier mixture. A device using only toner is feasible for miniaturization and basically maintenance-free, compared to a device using a toner and carrier mixture. However, the problem with the device using toner is that it is difficult to charge the toner evenly to a desired polarity. Toner particles charged to a polarity opposite to the desired polarity smear the background of a toner image and thereby deteriorate the image. Various kinds of schemes have been proposed to obviate this problem while making the most of the advantages of this type of developer.

The developing device using the toner may have a soft developing roller as toner conveying means. However, the soft roller is apt to suffer from a creep (permanent compression set) and fail to contact a photocoductive element, or image carrier, and a blade evenly. This prevents the blade from forming a uniform thin toner layer on the roller. The soft developing roller may be replaced with a hard developing roller in order to eliminate the above occurrence. The soft roller has customarily been combined with an image carrier implemented as a photoconductive belt. Hence, the soft roller is not practical without resorting to a drive mechanism including a drive roller and gears. Further, because the belt becomes offset due to an uneven tension distribution thereof, an extra mechanism must be provided against the offset.

Moreover, the conventional device, whether the developing roller be soft or hard, cannot eliminate the toner charged to the opposite polarity and, therefore, the background contamination attributable thereto.

In the light of the above, there has been proposed a developing device having both a hard first developing roller and a soft second developing roller. The first roller, or first conveying means, is formed with magnetic poles on the periphery thereof and magnetically causes the toner to deposit thereon. The toner is electrostatically transferred from the first roller to the second roller or second conveying means. The second roller is rotated to convey the toner to a developing position where an image carrier is located. With the two rollers, the device is capable of preventing the toner of opposite polarity from arriving at the developing position.

Specifically, the toner is usually charged by friction when it is passes through between the first roller and the blade. To charge the toner evenly, it is necessary to limit the amount of toner deposition on the first roller for a unit area. Should more than the limited amount of toner be deposited on and conveyed by the first roller, there would increase the amount of uncharged particles, particles of short charge, and particles of opposite polarity. The above conventional device cannot prevent the toner of short charge from arriving at the developing position although it can intercept the uncharged toner and the toner of opposite polarity. When a latent image is developed by the toner of short charge, the resulting toner image lacks a desired image density or a desired density ratio. In addition, when the toner deposits on the latent image in more than a predetermined amount, it melts, when transferred to a paper and fixed by a fixing unit, and runs into the white background of the paper, thereby defacing the image.

Assume that the amount of toner for a unit area is limited on the first roller in order to charge the toner evenly while obviating the deterioration of an image. Then, the amount of toner which can be transferred to the latent image formed on the drum is also limited. Hence, it is likely that the image fails to have a sufficient density. To settle this situation, the second roller may be rotated at a peripheral speed two to three times as high as the peripheral speed of the drum. This will successfully increase the amount of toner to deposit on the second roller for a unit area. However, if the peripheral speed of the second roller is excessively higher than that of the drum, a scavenging force, acting on the toner reached the drum, is intensified and blurs the leading edge of the image or concentrates the toner at the trailing edge of the image. Further, it is likely that the adhesion or smash of the toner occurs due to frictional heat, or that the toner is charged by friction at the developing position.

As stated above, although the second roller may be rotated at a higher peripheral speed than the drum in order to implement the amount of toner on the drum great enough to achieve a maximum image density, the peripheral speed of the second roller should be confined in a certain range. Therefore, it has been customary to determine the amount of toner deposition on the drum and the amount of toner deposition on the first roller by suitably balancing them with each other.

SUMMARY OF THE INVENTION

It is, therefore, an object of the present invention to provide a developing device for an image forming apparatus and capable of obviating the deterioration and irregular density distribution of an image attributable to the oppositely charged particles of toner or single component type developer.

It is another object of the present invention to provide a developing device for an image forming apparatus, and having a hard first conveying roller and a soft second conveying roller, and capable of forming a thin toner layer evenly on the first roller and depositing a constant charge on the toner.

It is another object of the present invention to provide toner, or single component type developer, for use with a developing device having a hard first conveying roller and a soft second conveying roller.

In accordance with the present invention, a developing device for an image forming apparatus and for developing a latent image electrostatically formed on an image carrier by toner has a first conveying member for conveying the toner deposited thereon, a regulating member contacting the first conveying means, and for regulating the toner on the conveying means to form a thin toner layer while charging the toner by friction, and a second conveying member contacting the first conveying member and the image carrier, and for receiving the toner from the first conveying member and causing the toner to deposit on the latent image of the image carrier. The regulating member and first conveying member contact each other under a pressure of higher than or equal to 20 gf but lower than or equal to 360 gf.

The regulating member and first conveying member may contact each other under a pressure of higher than or equal to 0 gf but lower than or equal to 360 gf. In this case, the regulating member bites into the first conveying means by at least −0.1 mm.

Also, in accordance with the present invention, a developing device for an image forming apparatus and for developing a latent image electrostatically formed on an image carrier by toner has a first conveying member for conveying the toner deposited thereon, a regulating member for regulating the amount of the toner to deposit on the first conveying member, and a second conveying member for receiving the toner from the first conveying member while the first and second conveying members are in rotation. The first and second conveying members contact each other at least during image formation.

The first and second conveying means may be rotated in opposite directions to each other. In this case, the first and second conveying means bite into each other at least during image formation.

Further, in accordance with the present invention, a developing device for an image forming apparatus and for developing a latent image electrostatically formed on a photoconductive drum by toner has a hard first developing roller formed with fine magnetic N-S poles on the periphery thereof, and for conveying the toner magnetically deposited thereon, a blade contacting the first developing roller, and for regulating the amount of the toner to be conveyed by the first developing roller while charging the toner passing through between the blade and the first developing roller by friction, a second developing roller softer than the first developing roller, and contacting the first developing roller, and for electrostatically attracting the toner of adequate charge, conveyed by the first developing roller, and conveying the toner toward the photoconductive drum, and two bias power sources each for applying a particular bias voltage to one of the first and second developing rollers. A contact pressure acting between the blade and the first developing roller and a projection of the edge portion of the blade from a point where the edge portion contacts the first developing roller are selected such that the toner is conveyed by the first developing roller in an amount of greater than or equal to 0.2 $mg/cm^2$ but smaller than or equal to 0.7 $mg/cm^2$ for a unit time and a unit area.

Moreover, in accordance with the present invention, toner for use with a developing device for an image forming apparatus and comprising a first conveying member for conveying the toner deposited thereon, a regulating member for regulating the toner on the first conveying member to form a thin toner layer while charging it by friction, a and second conveying member for causing the charged toner to deposit thereon at a position where the first and second conveying members contact each other has a volume resistivity of higher than or equal to $10^8$ Ωcm.

The toner may have a mean particle size of smaller than or equal to 12 μm.

The toner may contain magnetic powder dispersed in a content greater than or equal to 20 wt % but smaller than or equal to 60 wt % in each particle.

In addition, the toner may contain, in each particle, magnetic powder having a mean particle size smaller than or equal to 1 μm.

BRIEF DESCRIPTION OF THE DRAWINGS

The above and other objects, features and advantages of the present invention will become apparent from the following detailed description taken with the accompanying drawings in which:

FIG. 3 is a section showing a conventional developing device using both a soft developing roller and a hard developing roller and to which the present invention is applicable;

FIG. 4 is a section demonstrating how toner is moved in the device of FIG. 3;

DESCRIPTION OF THE PREFERRED EMBODIMENTS

Figure 1:
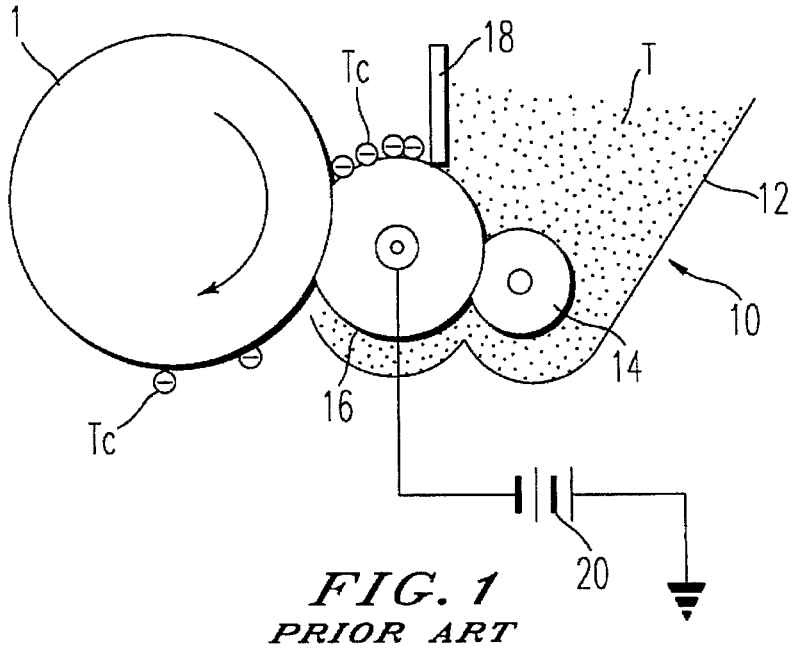
FIG. 1 PRIOR ART
FIG. 1 is a section of a conventional developing device using a soft developing roller.

To better understand the present invention, a brief reference will be made to a conventional developing device using a soft developing roller, shown in FIG. 1. As shown, the developing device, generally 10, has a hopper 12 storing fresh toner T, a toner supply roller 14, a soft developing roller 16, a blade 18 contacting the roller 16, and a high-tension power source 20. The supply roller 14 conveys the toner T from the hopper 12 to the developing roller 16. The toner T is charged by friction acting between the rollers 14 and 16. A bias is applied from the power source 20 to the roller 16. As a result, the charged toner, labeled Tc, is electrostatically deposited on the roller 16. The roller 16 conveys the toner Tc to a nip portion where the roller 16 contacts an image carrier implemented as a photoconductive drum 1. The drum 1 is included in an image forming apparatus on which the device 10 is mounted. The blade 18 regulates the toner Tc, being conveyed by the roller 16, to form a uniform thin toner layer. Because the drum 1 is made of a hard material, the nip portion is formed by the soft developing roller 16. At the nip portion, the toner Tc is transferred from the roller 16 to the drum 1 so as to develop a latent image electrostatically formed on the drum 1.

The developing device 10 has some problems yet to be solved, as follows. Because the developing roller 16 is soft, it is difficult for the blade 18 to form a uniform thin toner layer on the roller 16. The soft roller 16 is apt to suffer from a creep (permanent compression set). The creep prevents the roller 16 from contacting the blade 18 and drum 1 evenly, resulting in defective development. Because it is difficult to charge the toner uniformly, toner charged to a polarity opposite to an expected polarity occurs and causes, for example, smears to appear on the background of an image.

Figure 2:
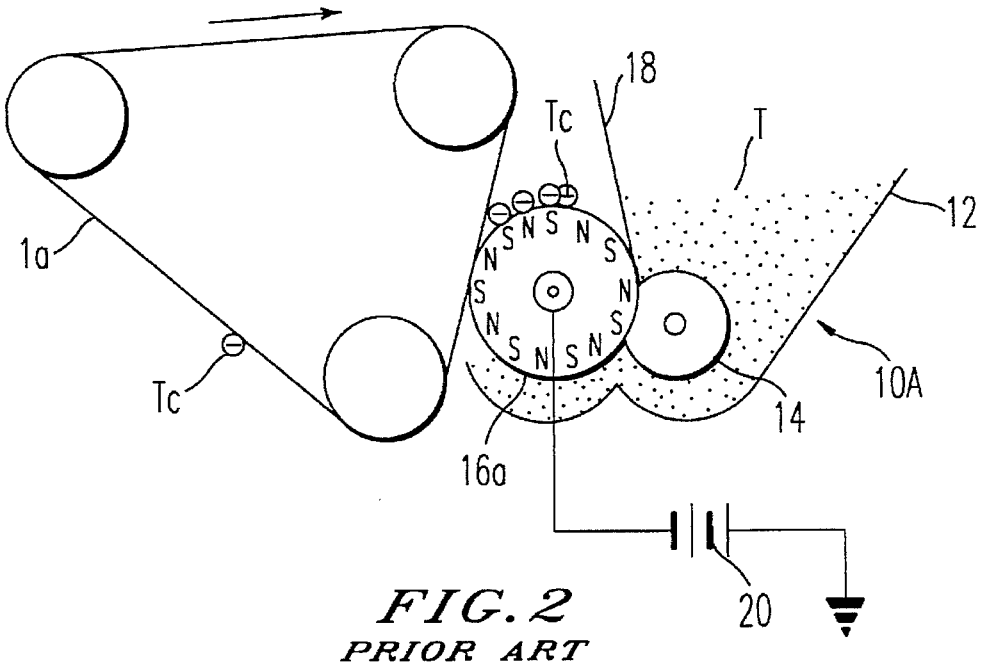
FIG. 2 PRIOR ART
FIG. 2 is a section showing a conventional developing device using a hard developing roller.

FIG. 2 shows another conventional developing device which uses a hard developing roller. As shown, the developing device, generally 10A, has a hard developing roller 16*a* in place of the soft developing roller 16, FIG. 1. The toner T fed from the hopper 12 by the supply roller 14 is deposited on the magnetized surface of the developing roller 16*a*. The toner T is charged by the friction between it and the blade 18, regulating the thickness of the toner T, and the friction between its particles. The charged toner Tc is conveyed by the roller 16*a* to a nip portion where the roller 16*a* contacts a photoconductive belt 1*a*. Because the roller 16*a* is made of a hard material, the nip portion is formed by the belt 1*a*. The charged toner Tc is transferred to the belt 1*a* in the same manner as in FIG. 1.

However, the developing device 10A needs a drive mechanism, including a drive roller and gears, for driving the belt 1*a*. The drive mechanism increases the cost of the device 10A. Because the belt 1*a* is apt to become offset due to an irregular tension distribution or similar cause, an extra mechanism for coping with the offset is required. In addition, the device 10A also suffers from the toner charged to the opposite polarity.

FIG. 3 shows still another conventional developing device which has both a hard developing roller and a soft developing roller and uses only toner, as distinguished from a toner and carrier mixture. As shown, the developing device, generally 30, has a hopper 32 storing fresh toner T, a supply roller 34, a hard first developing roller or developing means 36 implemented by a rubber magnet or the like, a second developing roller or developing means 38 having a soft surface and contacting the first roller 36 and a photoconductive drum 1, a blade or toner regulating means 40 contacting the second roller 36, a power source 42 for toner transfer, and a bias power source (HV) 44 for development. The toner T is caused to form a thin layer on the first roller 36 while being charged. The charged toner T is conveyed by the first roller 36 to a nip portion where the roller 36 contacts the second roller 38. The nip portion is implemented by the elastic deformation of the second roller 38. A bias voltage F1 (V) is applied from the power source 42 to the first roller 36 in order to transfer the toner T from the roller 36 to the roller 38. Likewise, a bias voltage F2 (V) is applied from the power source 44 to the second roller 38 for development. The transfer of the toner T from the roller 36 to the roller 38 occurs when the bias voltages F1 and F2 satisfy any one of the following conditions:

(i) $F1<F2<0$ when the toner T is negatively charged and negative-to-positive development is effected;

(ii) $0<F1<F2$ when the toner T is negatively charged and positive-to-positive development is effected;

(iii) $0<F2<F1$ when the toner T is positively charged and negative-to-positive development is effected; and (iv) $F2<F1<0$ when the toner T is positively charged and positive-to-positive development is effected.

The toner Tc transferred to the second roller 38 is conveyed to the nip portion, or developing position, formed between the roller 38 and the drum 1 by the elastic deformation of the roller 38. At this position, the toner Tc is transferred from the roller 38 to the drum 1 to develop a latent image carried on the drum 1.

FIG. 4 demonstrates the transfer of the toner T to occur when it is negatively charged and negative-to-positive development is effected. As shown, the toner Tc, mainly charged to the negative polarity, is deposited on the first roller 36 and then on the second roller 38. The toner T+ charged to the opposite polarity and deposited on the roller 36 is not transferred to the roller 38. This successfully eliminates background contamination and other defects.

Figure 5:
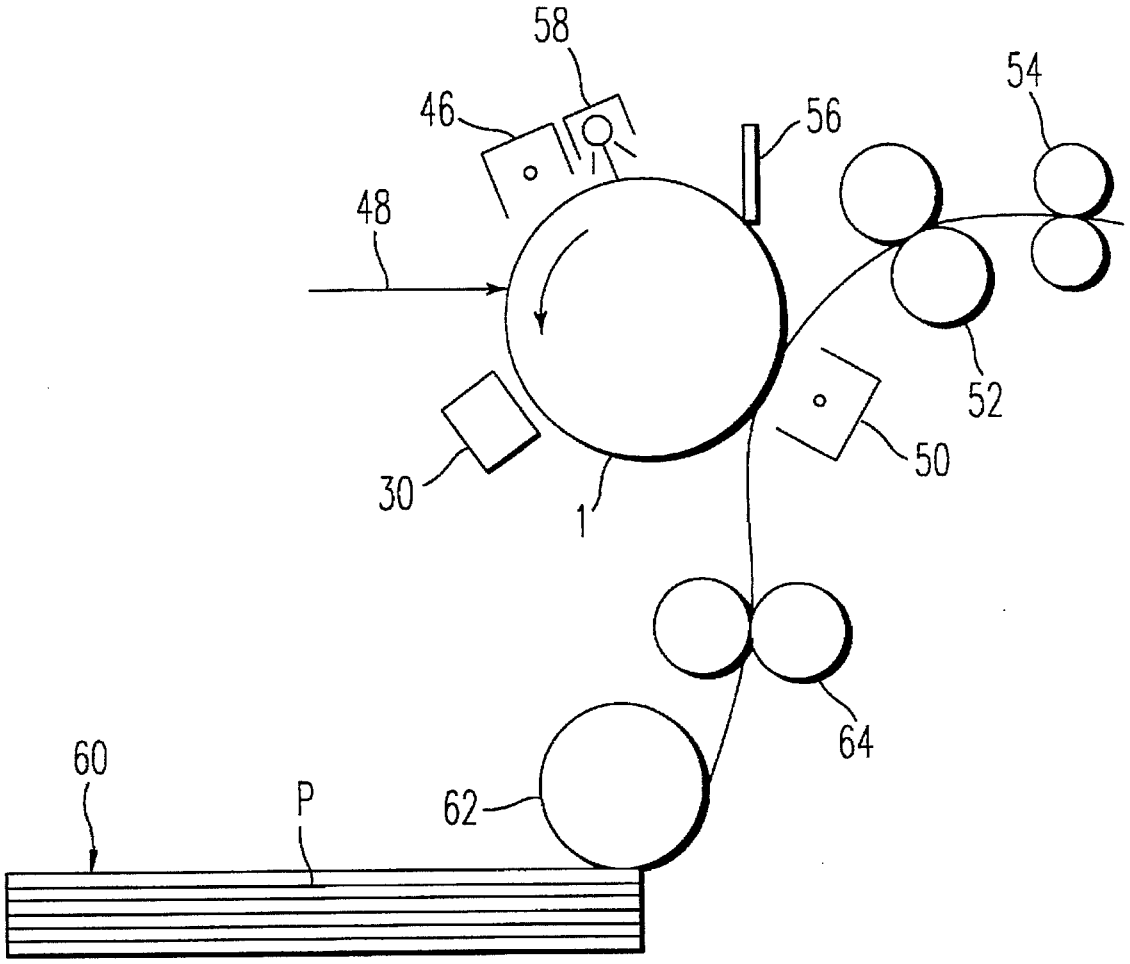
FIG. 5 is a section of an image forming apparatus implemented with the device of FIG. 3.

A copier or similar image forming apparatus implemented with the developing device 30 is shown in FIG. 5. As sown, the apparatus has a charger 46, an optical writing device 48, an image transfer unit 50, a fixing unit 52, an outlet roller pair 54, a cleaning blade 56, a discharger 58, a cassette 60 loaded with papers P, a pick-up roller 62, and a registration roller pair 64. The drum 1 is rotatable counterclockwise as indicated by an arrow in the figure. The charger 46 uniformly charges the surface of the drum 1. The charged surface of the drum 1 is sequentially moved due to the rotation of the drum 1. The writing device 48 exposes the charged surface of the drum 1 imagewise to thereby electrostatically form a latent image. As the drum 1 is further rotated, the developing device 30 develops the latent image with toner and thereby forms a corresponding toner image on the drum 1. One paper P is fed from the cassette 60 to the image transfer unit 50 via the pick-up roller 62 and registration roller pair 64 at a predetermined timing. As a result, the toner image is transferred from the drum 1 to the paper P by the transfer unit 50. After the toner image has been fixed on the paper P by the fixing unit 52, the paper P is driven out of the apparatus by the outlet roller pair 54. After the image transfer, the toner remaining on the drum 1 is removed by the cleaning unit 56, and then the charges remaining on the drum 1 are dissipated by the discharger 58. As a result, the surface potential of the drum 1 is restored to zero. These consecutive steps may be repeated to produce a desired number of copies.

The developing device 30, FIG. 3, having two developing rollers 36 and 38 is capable of obviating the oppositely charged toner at low cost. However, because the toner is fed from the first roller 36 to the drum 1 by way of the second roller 38, the development of the latent image on the drum 1 is critically affected by the thickness and charge distribution of the toner layer on the roller 36.

Preferred embodiments of the developing device in accordance with the present invention will be described hereinafter. The embodiments are practicable with, but not limited to, a device having two developing rollers, as shown in FIGS. 3 and 5, negatively chargeable toner, and negative-to-positive development. In the embodiments, the same or similar constituent parts as or to the parts shown in FIGS. 3 and 5 are designated by the same reference numerals, and a detailed description thereof will not be made in order to avoid redundancy.

FIRST EMBODIMENT

Figure 6:
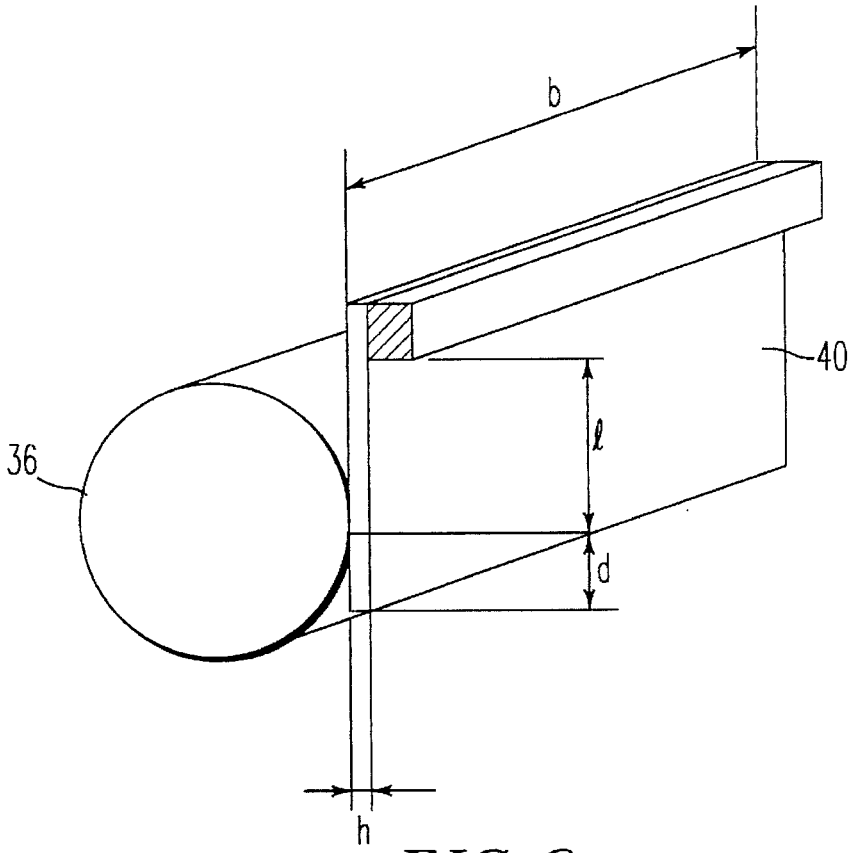
FIG. 6 is a fragmentary perspective view of a first embodiment of the developing device in accordance with the present invention.
Figure 7:
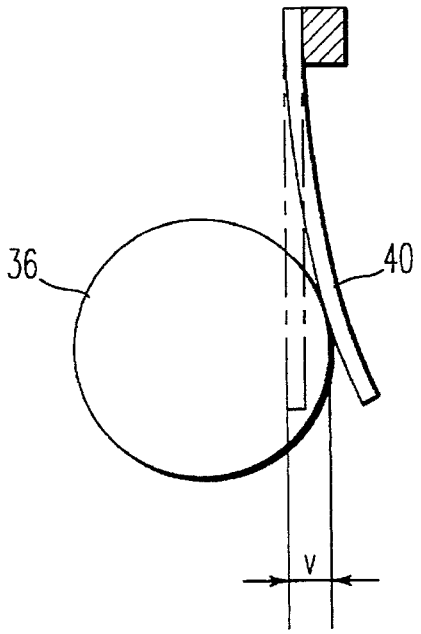
FIG. 7 is a side elevation associated with FIG. 6.

As shown in FIG. 6, the developing device has a blade 40 and holds the blade 40 in contact with a first developing roller 36 in a unique configuration. The blade 40 has a width or lengthwise direction b, a thickness h, and a projection d as measured from the free edge of the blade 40 to the point where the blade 40 contacts the roller 36. Labeled l is a free length as measured from the other fixed edge of the blade 40 to the point where the blade 40 contacts the roller 36. As shown in FIG. 7, the blade 40 bites into the roller 36 by an amount v corresponding to the displacement between the straight position of the blade 40 and the position of the same contacting the roller 36.

Figure 8:
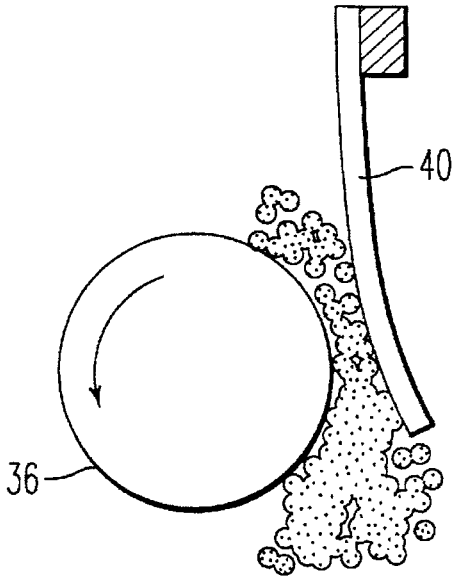
FIG. 8 is a section showing a condition wherein toner urges a blade away from a developing roller, and apt to occur when the contact pressure between the blade and the roller is lower than 20 gf.
Figure 9A:
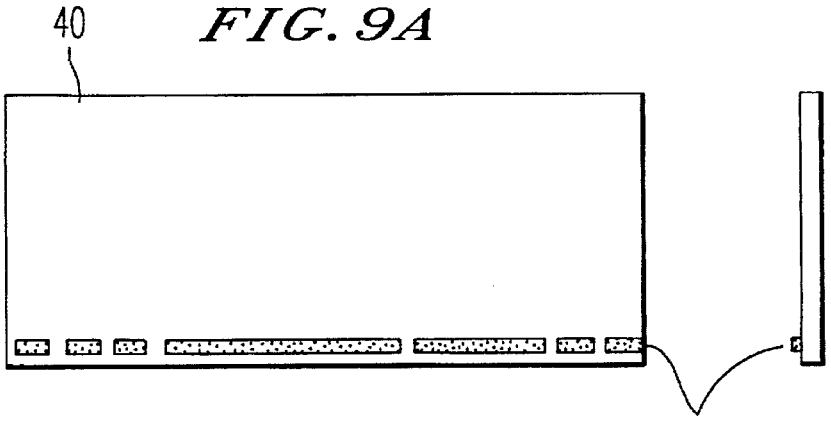
FIG. 9 shows a specific surface condition of the developing roller wherein toner is deposited in irregular thickness, and apt to occur when the Contact pressure is higher than 360 gf.
Figure 9B:
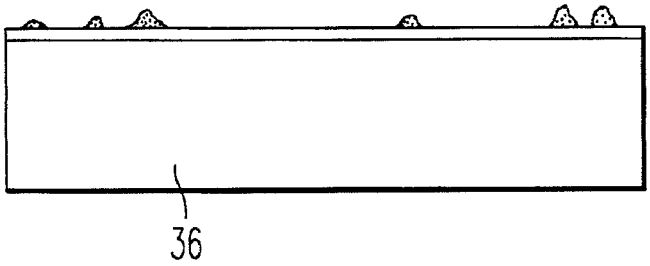

The pressure of the blade 40 acting on the roller 36 is one of the major factors for allowing the toner to form a uniformly charged thin layer on the roller 36. Experiments showed that, as indicated in FIG. 8, contact pressures lower than 20 gf cause a great amount of toner fed to the roller 36 at a position short of the blade 40 to urge the blade 40 away from the roller 36. This prevented the toner from forming a thin layer and thereby aggravated irregularities in the amount of toner for a unit area and toner distribution on the roller 36. Further, the amount of charge to deposit on the toner decreased. When the contact pressure was higher than 360 gf, the toner sequentially formed a film on the roller 36 and adhered to the blade 40. As a result, the toner layer on the roller 36 was extremely irregular in thickness, as shown in FIG. 9. Therefore, assuming that the contact pressure is P, there should be satisfied 20 gf≦P≦360 gf.

Further, the contact pressure P may be expressed as:

$$P=(E\cdot b\cdot h^3\cdot v)/(4\cdot l^3) \qquad \text{Eq. (1)}$$

where E is the Young's modulus of a member used as the blade 40. It follows that a stable toner layer is achievable if b, h, v and l are so selected as to satisfy the relation 20 gf≦P≦360 gf.

Assume that the roller 36 and blade 40 are implemented by a magnetic roller and a magnetic member, respectively. Then, because the roller 36 magnetically attracts the blade 40, a contact pressure for regulating the toner is attained even if the contact pressure P is zero. For example, when the flux density of the roller 36 was 280 G and the blade 40 was made of stainless steel (SUS), the toner was adequately charged and allowed to form a thin layer if the amount of bite v is greater than or equal to −0.1 mm. Again, contact pressures higher than 360 gf caused the thickness of the toner layer on the roller 36 to become extremely irregular.

The experiments, therefore, showed that defective images do not occur if the following relations are satisfied:

$$0gf \leqq P \leqq 360\ gf$$

$$v \geqq -0.1\ \text{mm}$$

Hence, by selecting the parameters of the Eq. (1) such that the above two relations hold, it is possible to form a stable toner layer on the roller 36.

Figure 10:
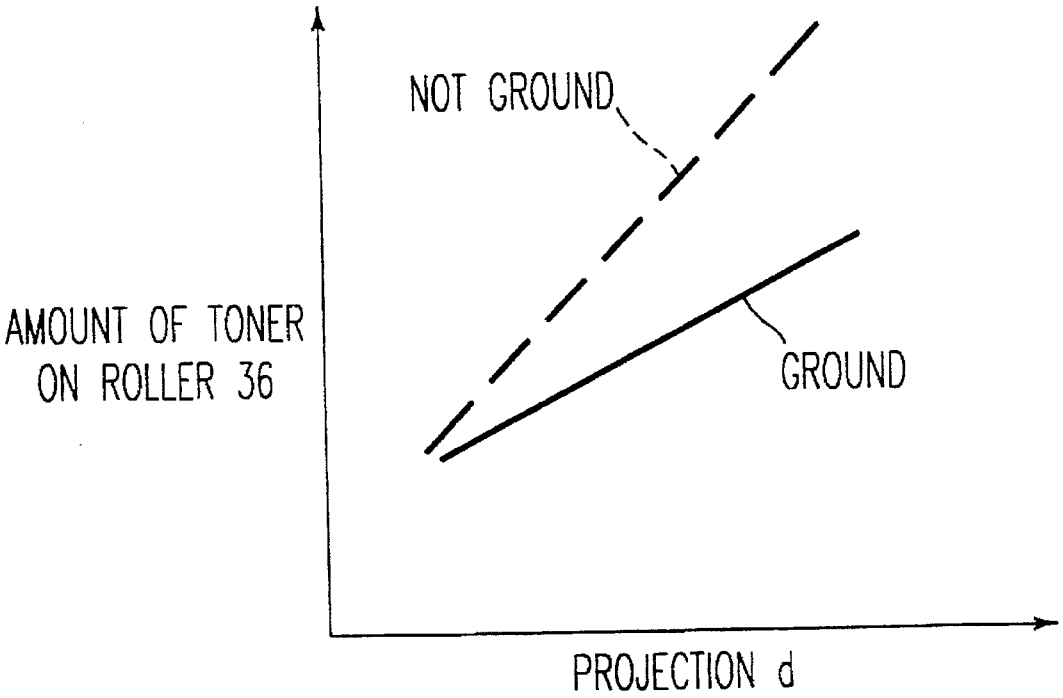
FIG. 10 is a graph showing a relation between the projection of the blade and the amount of toner to deposit on the roller with respect to a case wherein the edge of the blade is ground and a case wherein it is not ground.

The edge of the blade 40 may be ground, if desired. It was found that when the blade 40 has a ground edge, the gradient of a graph, shown in FIG. 10, decreases, and that the amount of toner on the roller 36 is stabilized. Specifically, when the edge of the blade 40 is ground, the change in the thickness of the toner on the roller 36 decreases relative to the projection d of the blade 40. In addition, the ground edge reduces the change in the toner thickness on the roller 36 against wear due to aging, compared to an undulant edge. Consequently, a stable toner layer is achievable with high reliability.

As stated above, the embodiment confines the contact pressure of the blade 40 acting on the roller 36 in the range of 20 gf≦P≦360 gf. In this condition, the uniformly charged toner can constantly form a thin layer on the roller 36, thereby eliminating defective images. Further, when the contact pressure is held in the range of 0 gf≦P≦360 gf and the amount of bite is held in the range of v≧−0.1 mm, the uniformly charged toner can also constantly form a thin layer on the roller 36. In addition, when the edge of the blade 40 is ground, the change in the thickness of the toner on the roller 36 decreases relative to the projection d of the blade 40 and against wear due to aging. This enhances reliable development.

2ND EMBODIMENT

In the developing device 30, FIG. 3, an electric field causing the toner Tc to move from the first roller 36 to the second roller 38 is formed. Hence, the amount of toner tends to increase unless it is restricted on the roller 38. In the light of this, this embodiment restricts the amount of toner by causing the two rollers 36 and 38 to contact each other.

Figure 11:
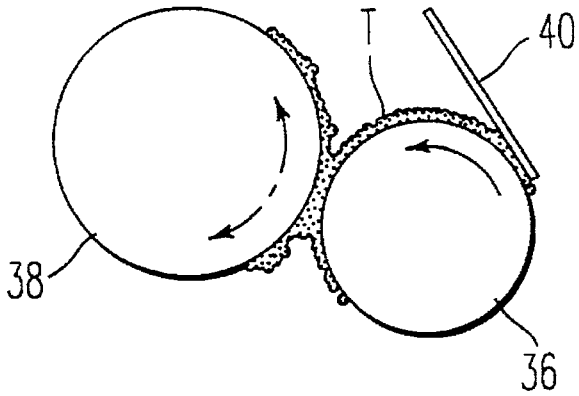
FIG. 11 shows the transfer of toner representative of a second embodiment of the present invention.

Specifically, the first roller 36 was implemented as a rubber magnet, while the second roller 38 was implemented as a sponge roller and covered with a rubber tube whose surface was coated with a conductive paint. Toner was supplied while the two rollers 36 and 38 (smallest diameter portions in consideration of jitter) were held in contact in the same plane. In this condition, when the rollers 36 and 38 were rotated in the forward direction (solid arrows in FIG. 11) at a linear velocity ratio of 3 (roller 36) :1 (roller 38), the amount of toner saturated in about 0.3 mg/cm$^2$ on the roller 36 or in about 1.4 mg/cm$^2$ on the roller 38. On the other hand, when the rollers 36 and 38 are reversed (roller 38 rotating in a direction indicated by a phantom arrow in FIG. 11), at a linear velocity ratio of 3:−1, the amount of toner saturated in about 0.3 mg/cm$^2$ on the roller 36 or in about 1.1 mg/cm$^2$ on the roller 38.

Figure 12:
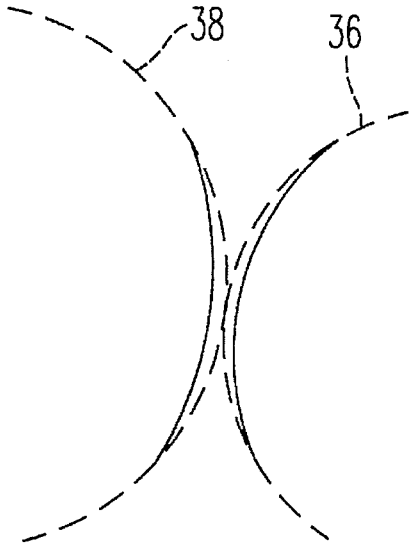
FIG. 12 demonstrates how the toner is regulated in amount in the second embodiment.

When the rollers 36 and 38 contact each other in the above condition, they are slightly deformed at the nip portion when the toner is passed therebetween. In FIG. 12, phantom lines indicate the original positions of the rollers 36 and 38. As a result, the amount of toner is regulated.

Figure 13:
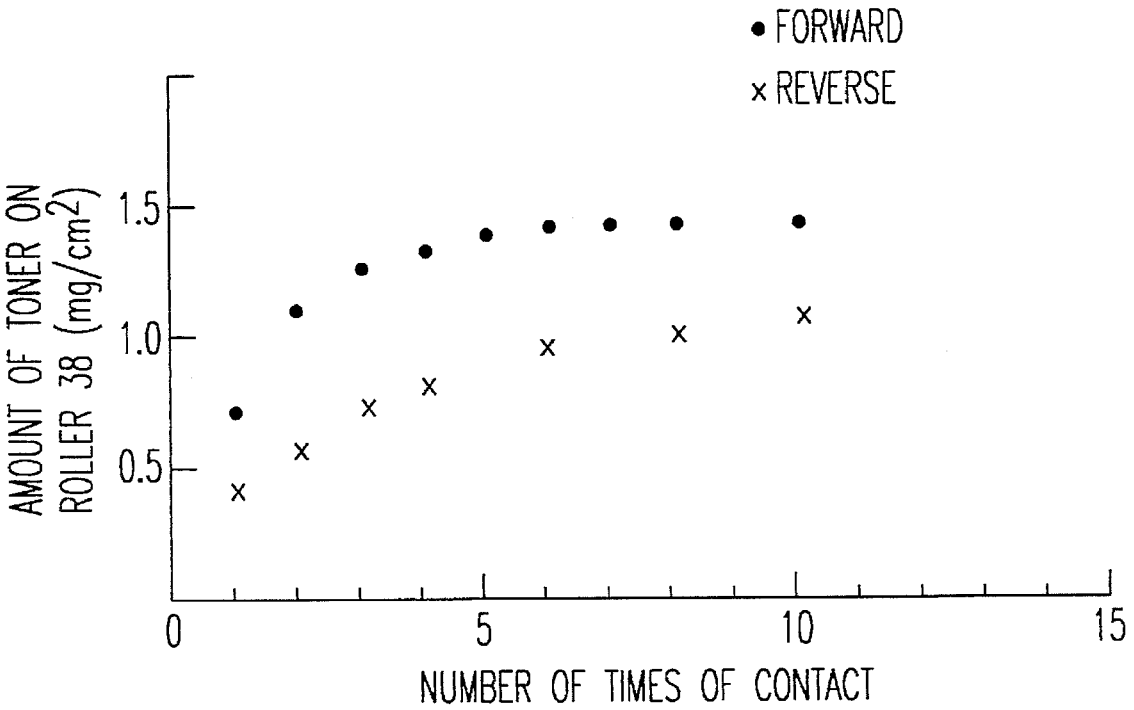
FIG. 13 shows how the amount of toner on a second developing roller changes in the second embodiment.

FIG. 13 shows changes in the amount of toner on the second roller 38. It will be seen that the amount of toner on the roller 38 can be easily regulated if the rollers 36 and 38 are held in contact, although it depends on how many times they contact.

Of course, the amount of toner on the roller 38 can be regulated even if the rollers 36 and 38 do not contact each other, i.e., only if they are spaced apart by a certain gap. In this case, the prerequisite for the adequate toner amount (about 1 mg/cm$^2$ to 1.2 mg/cm$^2$) to be satisfied is that the gap be maintained extremely small (thickness of several toner layers; several tens of microns). However, such a gap is difficult to form due to the dimensional tolerances (distance between the axes, jitter of the rollers, etc.), so that the irregularity in the amount of toner is aggravated. Surely maintaining the gap is difficult in the technical aspect and would increase the cost.

Figure 14:
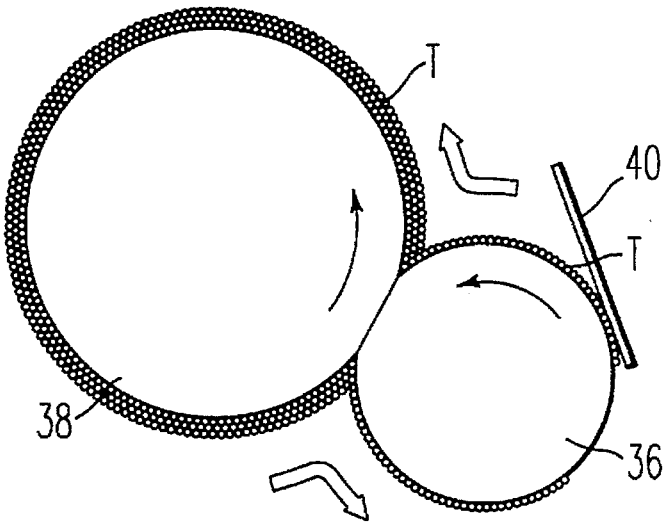
FIG. 14 shows a modification of the second embodiment.

In the light of the above, as shown in FIG. 14, the embodiment may be modified such that the rollers 36 and 38 move in opposite directions to each other at the nip portion and slightly bite into each other. This configuration makes it difficult for the toner T to pass through the nip portion. In this condition, when the toner T is transferred from the roller 36 to the roller 38, the amount of toner on the roller 38 is simply determined by the amount of toner on the roller 36 and the linear velocity ratio. Moreover, the toner T passed through the developing position, where the drum 1 is located, is returned to and collected by the roller 36. As a result, the toner on the roller 38 is not only maintained in a constant amount, but also refreshed every time the roller 36 is rotated. Hence, the change in the amount of toner on the roller 38 due to the repeated contact of the rollers 36 and 38 is reduced. This successfully allows a minimum of residual image to occur.

Figure 15:
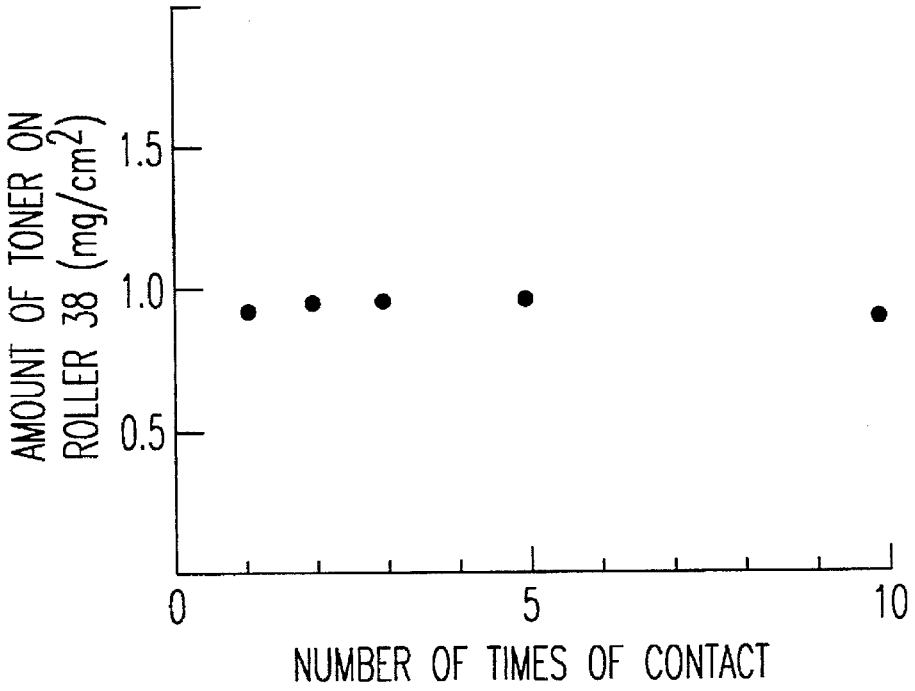
FIG. 15 shows a relation between the amount of toner on the second roller and the number of times of contact of the two rollers.

FIG. 15 shows a relation between the amount of toner on the roller 38 and the number of times of contact of the rollers 36 and 38. This relation was determined with the above modification and when the rollers 36 and 38 respectively had diameters of 16 cm and 20 cm and had a hardness of about 50 degrees in terms of asker C, when they were rotated at a linear velocity ratio of 3:−1 while biting into each other by 0.4 mm, and when the amount of toner on the roller 38 was 0.3 mg/cm$^2$. As shown, the amount of toner on the roller 38 was about 0.9 mg/cm$^2$ without regard to the number of times of contact of the rollers 36 and 38.

Figure 16:
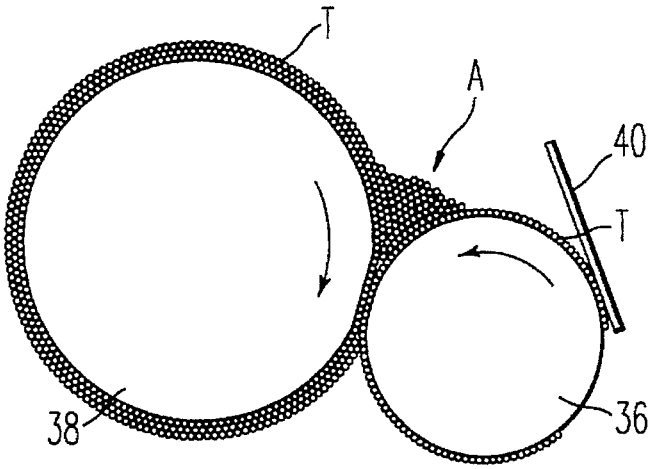
FIG. 16 shows the regulation of the amount of toner to occur when the two rollers are rotated forward while biting into each other.

For comparison, assume that the rollers 36 and 38 are rotated in the forward direction while biting into each other, as shown in FIG. 16. Then, the amount of toner which can pass through the nip portion changes, depending on the contact condition and linear velocity ratio of the rollers 36 and 38. However, during image formation, the toner T mainly moves from the roller 36 to the roller 38, but it scarcely moves from the latter to the former. In addition, the toner T is apt to accumulate in a portion A shown in FIG. 16.

In the modification, the above advantage is attainable only if the rollers 36 and 38 bite into each other. It was found by experiments that when the rollers 36 and 38 bite each other by more than 0.5 mm, hardly any toner T is allowed to pass; through the nip portion, i.e., the stripping effect of the rollers 36 and 38 is enhanced. However, an increase in the amount of bite does not proportionally enhance the stripping effect; rather, it increases the deformation of the rollers 36 and 38 and is apt to cause a creep to occur. The creep depends on the materials, diameters and amounts of bite of the rollers 36 and 38 as well as on the environment surrounding them. A creep test (30 days in a 35° C., 85% RH atmosphere) showed that if the amount of bite is less than 2 ram, the creep of the rollers 36 and 38 lies in an allowable range in respect of image quality, and that the amount of bite should preferably be less than 1.5 mm. As for the hardness, a "hard and soft" combination was more desirable in stripping effect than a "soft and soft" combination for a given amount of bite.

If the second roller 38 is soft, it can effect development in contact with the hard drum 1. When use is made of magnetic toner, the roller 38 is implemented as a magnet roller. However, at the present stage of development, a soft magnet roller is more expensive than a hard magnet roller. Hence, it is more effective to make the roller 38 softer than the roller 36 and cause the latter to bite into the former.

When experiments were conducted with rollers 36 having a hardness of about 99 degrees in asker C and rollers 38 having hardnesses of about 35 degrees to 70 degrees, hardly any toner was allowed to pass through the nip portion when the rollers 36 and 38 bit into each other by more than 0.3 mm. This means that the stripping effect is noticeable despite such a small amount of bite. However, an increase in the amount of bite does not proportionally enhance the stripping effect; rather, it increases the deformation of the rollers 36 and 38 and is apt to cause a creep to occur, as stated earlier. Again, the creep depends on the materials, diameters and amounts of bite of the rollers 36 and 38 as well as on the environment surrounding them. A creep test (30 days in a 35° C., 85% RH atmosphere) showed that if the amount of bite is less than 1.3 mm, the creep of the rollers 36 and 38 lies in an allowable range in respect of image quality, and that the amount of bite should preferably be less than 0.8 mm. Low hardnesses are desirable because they broaden the range of allowable amounts of bite and thereby promote free adjustment, while reducing the required drive torque.

Figure 17:
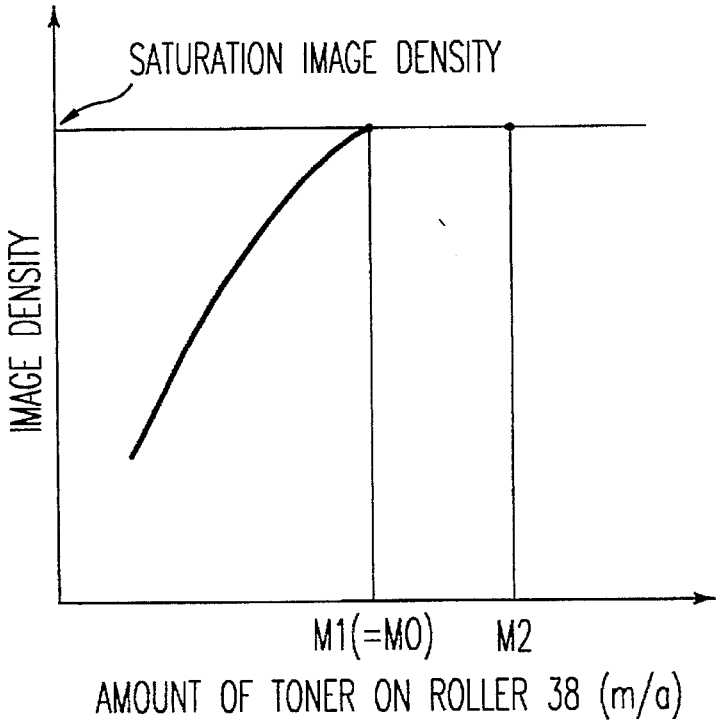
FIG. 17 is a graph indicative of a relation between the image density and the amount of toner.

FIG. 17 shows a relation between the second roller 38 and the density of an image. As shown, so long as the amount of toner on the roller 38 is less than $M_0$, the image density increases with an increase in the amount of toner. The image density saturates at $M_0$. Therefore, to prevent the image density from changing when the amount of toner on the roller 38 changes, it is necessary that the amount of toner be selected in a range capable of implementing the saturation density. However, the amount of toner should be as small as possible because an increase in the amount of toner directly translates into an increase in toner consumption. To satisfy these conditions at a time, it is necessary to confine the amount of toner m/a on the roller 58 in a range of $M_1$ ($M_0=M_1$ in the embodiment)$\leqq m/a \leqq M_2$.

Figure 18:
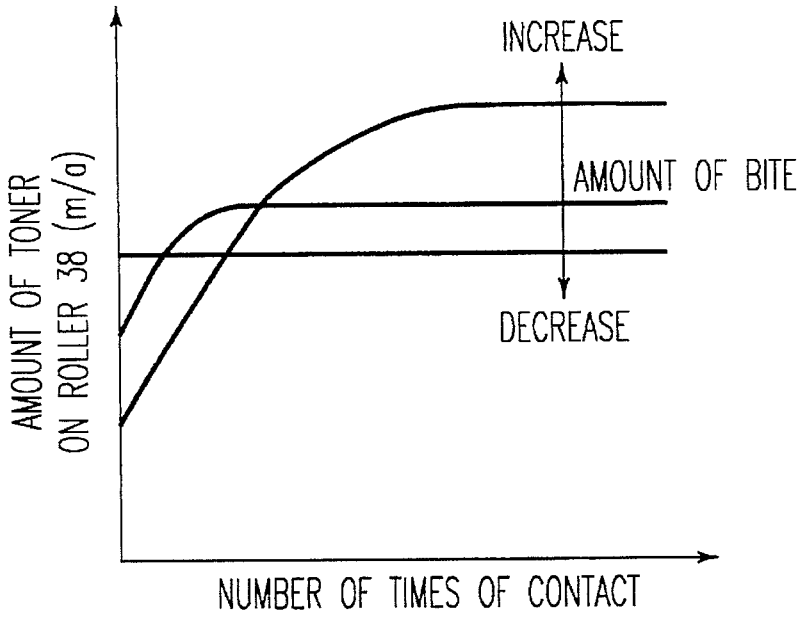
FIG. 18 is a graph representative of a relation between the amount of toner and the number of times of contact of the two rollers.

On the other hand, while the drum 1 is in rotation, the rollers 36 and 38 are constantly rotated, whether image formation be under way or not, in contact with each other. As shown in FIG. 18, the amount of toner m/a on the roller 38 is affected by the number of times of contact of the rollers 36 and 38 and the amount of bite thereof. Specifically, the amount m/a increases with an increase in the number of times of contact until it saturates. However, when the amount of bite is small, the number of times of contact necessary for the amount m/a to saturate increases. In addition, the difference between the amount m/a at the time of the first contact and the amount m/a at the time of saturation increases. When an image whose major part is occupied by black is developed, the toner on the roller 38 is consumed in a great amount with the result that the rollers 36 and 38 contact each other only once. By contrast, when a white image portion continues, the number of times of contact increases because the toner on the roller 38 is not consumed. Therefore, to maintain the image density constant, both the amount m/a at the time of a single contact and the amount m/a at the time of saturation should satisfy the above relation $M_1 \leqq m/a \leqq M_2$.

Figure 19:
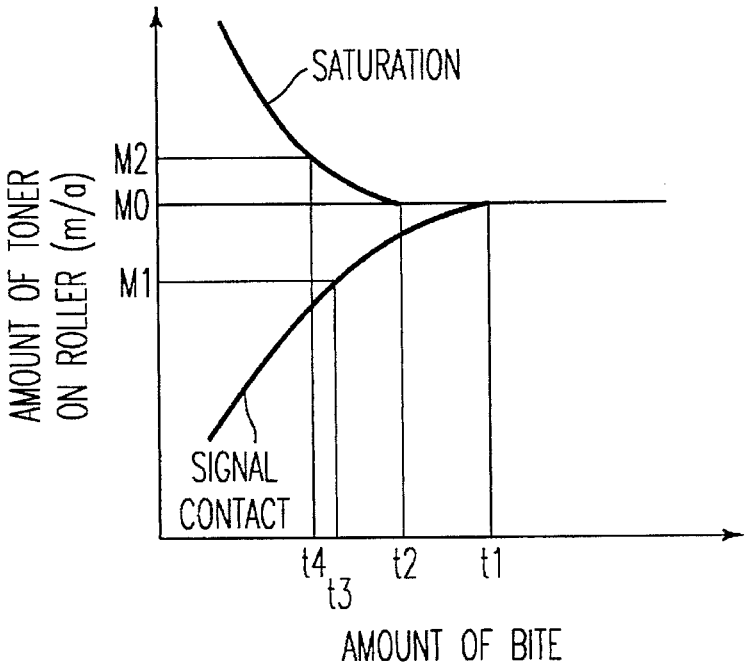
FIG. 19 shows a relation between the amount of toner and the: amount of bite.

FIG. 19 shows a relation between the amounts m/a at the time of a single contact and saturation and the amount of bite t of the rollers 36 and 38. As shown, as the amount t increases, the amount m/a at the time of a single contact increases and saturates at $t_1$. On the contrary, in the event of saturation, the amount m/a sequentially decreases with an increase in t and saturates at $t_2$. The saturation amount is substantially maintained constant ($M_0$). On the roller 38, the relation $M_1 \leqq m/a \leqq M_2$ should be satisfied, as stated earlier. Hence, there should be satisfied both a condition of $t \geqq t_3$ for a single contact and a condition of $t \geqq t_4$ for the saturation. While FIG. 19 shows a specific relation of $t_1 \geqq t_2 \geqq t_3 \geqq t_4$, the relation will change depending on, for example, the bias for development. Again, a relation satisfying both of the necessary conditions for a single contact and saturation is determined to be $t \geqq t_0$ ($t_0=t_3$ in FIG. 19).

Figure 20:
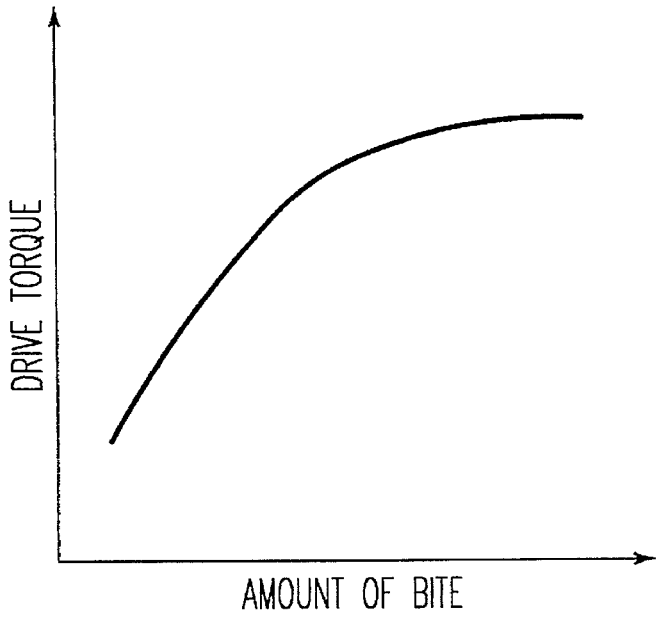
FIG. 20 is a graph indicative of a relation between the drive torque and the amount of bite.
Figure 21:
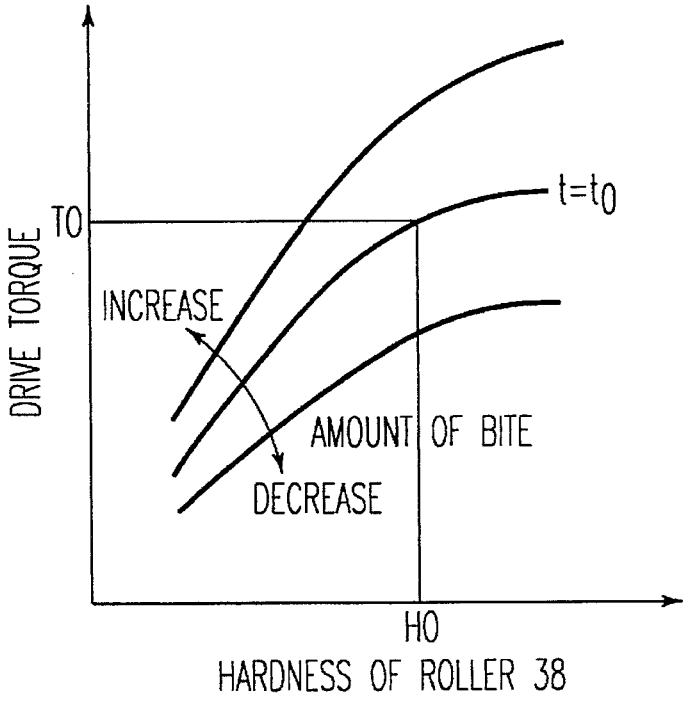
FIG. 21 is a graph indicative of a relation between the drive torque and the hardness of the second roller.

The rollers 36 and 38 slip on each other due to a difference in the direction and speed of rotation. As a result, as shown in FIG. 20, an increase in the amount of bite results in an increase in the torque necessary for driving the rollers 36 and 38. Further, as shown in FIG. 21, for a given amount of bite, the necessary torque increases with an increase in the hardness of the roller 38. The increase in required torque results in the need for a bulky motor and thereby increases the cost of the device. As FIG. 21 indicates, to maintain the torque lower than an allowable torque $T_0$, the rubber hardness should be less than $H_0$. It was found by experiments that the rubber hardness should be less than 60 degrees as prescribed by JIS-A.

As stated above, this embodiment maintains the rollers 36 and 38 in contact and controls the amount of toner to a predetermined amount by a gap produced by elastic deformation. Hence, even a toner or single component type developer can be uniformly charged. This ensures stable image formation by reducing the toner of opposite polarity. When line rollers 36 and 38 are rotated in opposite directions, they are caused to bite into each other in order to make it difficult for the toner to pass through the nip portion. In this condition, the amount of toner to be transferred is determined only on the basis of a linear velocity ratio, so that the amount of toner is stabilized. Further when the rollers 36 and 38 bite into each other, it is desirable to implement the roller 38 by a comparatively soft material in the aspect of the relation to the drum 1 and cost. In addition, the roller 38 is provided with a rubber hardness of less than 60 degrees as prescribed by JIS-A. This successfully reduces the torque necessary for the roller 38 to be driven.

3RD EMBODIMENT

This embodiment pertains to the amounts of toner to be conveyed by the rollers 36 and 38 and adopts the previously stated relation (i) between the bias voltages F1 and F2.

Figure 22:
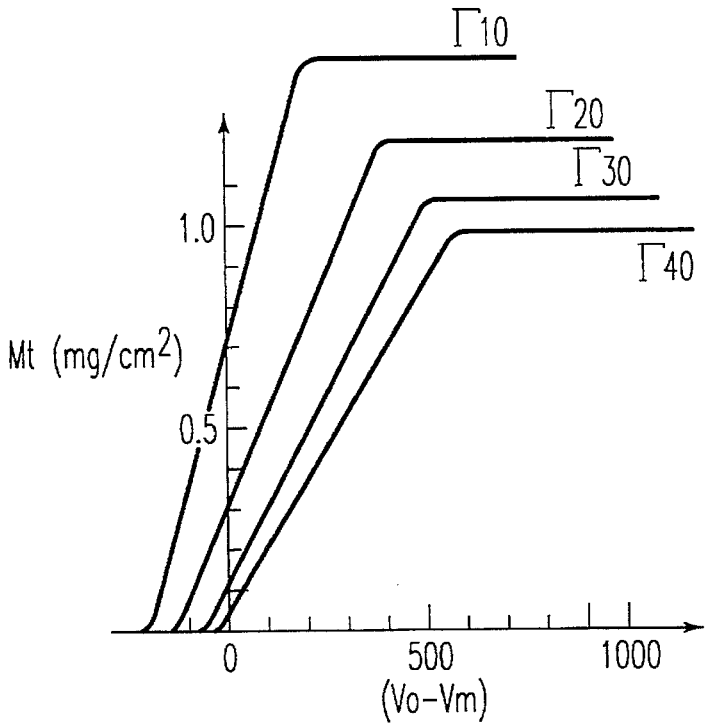
FIG. 22 shows a development gamma characteristic particular to a third embodiment of the present invention and determined in a 23° C., 50% RH atmosphere.

Referring again to FIGS. 3 and 4, when the amount of toner T passing through between the rollers 36 and 38 for a unit time and a unit area is changed, the amount of toner T to deposit on a latent image of maximum potential on the drum 1 for a unit time and a unit area increases. Assume that in a 2 3° C., 50% RH atmosphere, the roller 38 conveys the toner T in an amount of 1.4 mg/cm$^2$ far a unit time, and that the amount of toner to be conveyed by the roller 36 for a unit time and a unit area is changed. FIG. 22 shows a development gamma characteristic determined in such conditions. Specifically, assume that the electrostatic potential deposited on the drum 1 is Vo, that the surface potential of the drum 38 is Vm, and that the toner T is transferred to the latent image of maximum potential on the drum 1 in an amount of Mt g/(cm$^2$·t). Then, the characteristic shown in FIG. 22 refers to a relation between the difference (Vo–Vm) and the amount of toner Mt g/(cm$^2$·t). In FIG. 22, characteristic curves $\Gamma_{10}$, $\Gamma_{20}$, $\Gamma_{30}$ and $\Gamma_{40}$ were respectively determined when the amount mt2 of toner conveyed by the roller 38 were 0.7 mg/cm$^2$, 0.5 mg;/cm$^2$, 0.3 mg/cm$^2$, and 0.2 mg/cm$^2$. When the amount mt1 decreases to below 0.2 mg/cm$^2$, the toner T is easy to crash or adhere; when it increases to above 0.7 mg/cm$^2$, the toner T cannot be sufficiently charged. Preferably, therefore, the amount mt1 should be greater than 0.2 mg/cm$^2$, but smaller than 0.7 mg/cm$^2$.

Figure 23:
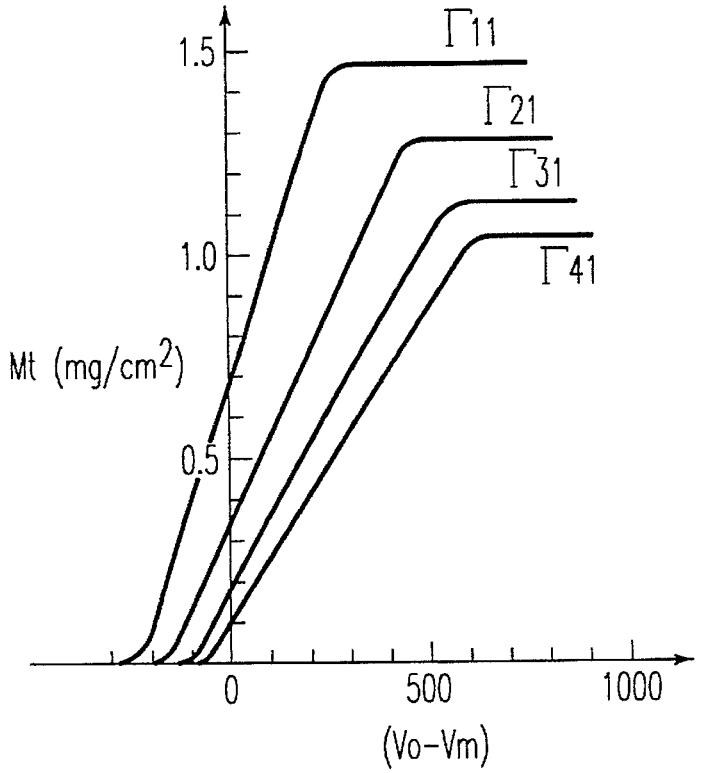
FIG. 23 shows a development gamma characteristic found after 30,000 times of repeated copying operation.
Figure 24:
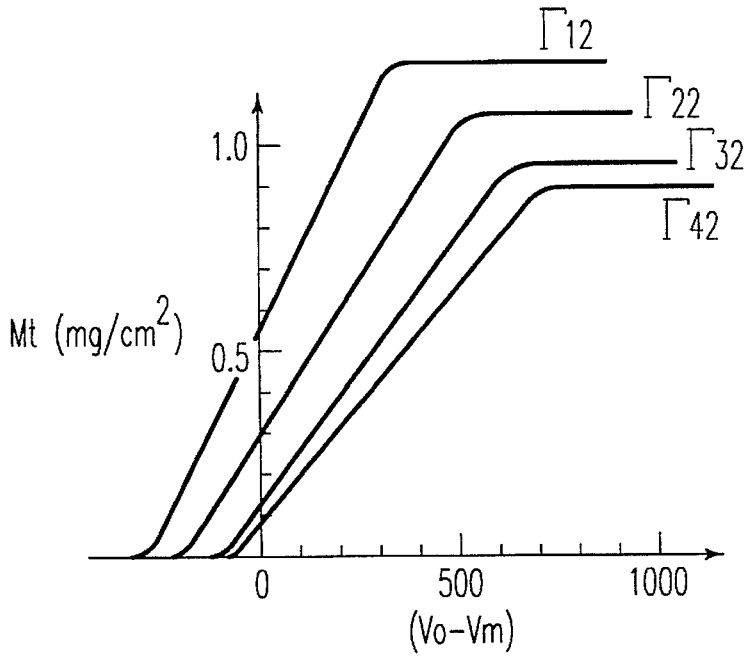
FIG. 24 shows a development gamma characteristic determined in a 5° C., 25% RH atmosphere.
Figure 25:
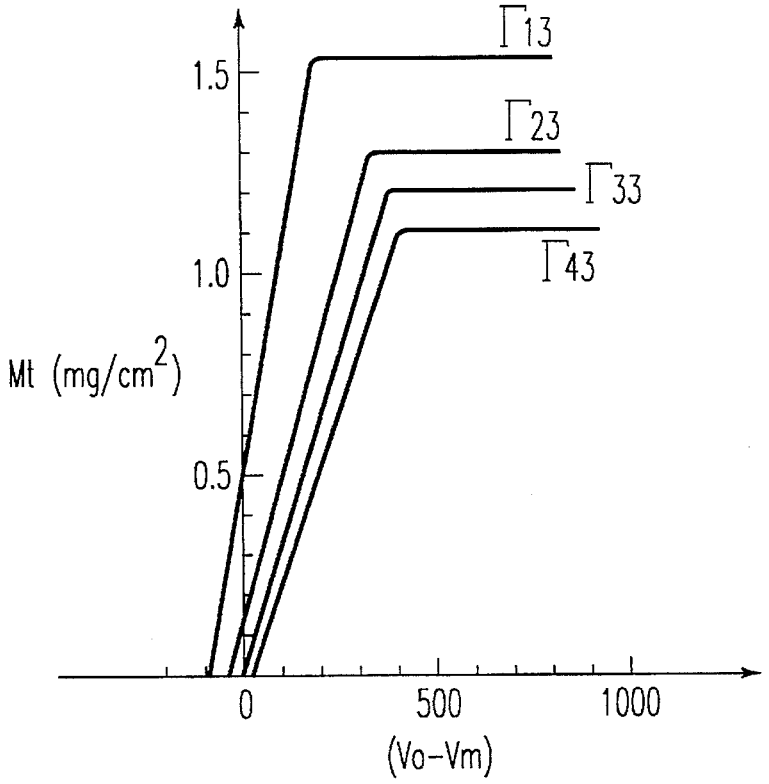
FIG. 25 shows a development gamma characteristic determined in a 35° C., 85% RH atmosphere.

The characteristic curves shown in FIG. 22 changes due to aging and surrounding conditions. FIG. 23 shows characteristic curves $\Gamma_{11}$–$\Gamma_{41}$ after the copying operation has been repeated 30,000 times. Further, FIGS. 24 and 25 respectively indicate characteristic curves $\Gamma_{12}$–$\Gamma_{42}$ obtained in a 5° C., 25% RH atmosphere, and characteristic curves $\Gamma_{13}$–$\Gamma_{43}$ obtained in a 3 5° C., 85% RH atmosphere. It will be seen that the amount of toner T to be transferred to the latent image of maximum potential on the drum 1 sequentially increases as the deterioration due to aging proceeds or as the temperature and humidity increase. However, only if the amount to be conveyed by the roller 36 for a unit time and a unit area is less than 0.7 mg/cm$^2$, the amount Mt to be transferred to the latent image of maximum potential remains lower than 1.5 mg/cm$^2$. This prevents the toner T transferred to a paper from melting and flowing into the white background.

Figure 26:
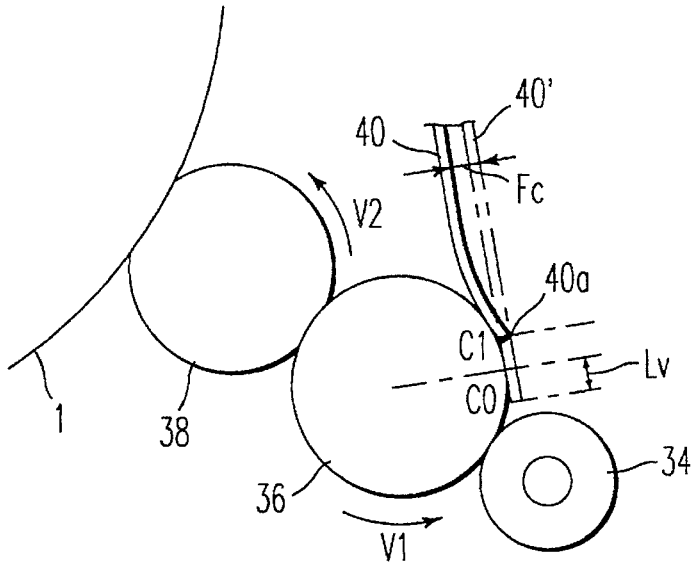
FIG. 26 demonstrates a method of adjusting the amount of toner to be conveyed.

To adjust the amount mt1 assigned to the roller 36, the contact pressure of the blade 40, made of stainless steel, acting on the roller 36 and the contact position thereof are adjusted. Specifically, as shown in FIG. 26, the blade 40 is pressed against the roller 36 by an amount of Fc from a position where it simply contacts the roller 36. At the same time, the blade 40 projects a distance Lv from a point $C_0$ where the edge 40*a* thereof contacts the roller 36. In practice, the distance Lv is negative and corresponds to a distance in the drawing direction. When the blade 40 is forced toward the roller 36 by the amount Fc, the blade 40 shifts its contact point $C_0$ to $C_l$ toward the base end of the blade 40.

The values Fc and Lv of the blade 40 were changed to measure the resulting amounts mt1 of toner conveyance by the roller 36. The distance Lv provided mt1=0.2 mg/cm$^2$ and the distance Lv provided mt1=0.7 mg/cm$^2$ were measured to be −0.5 mm and −1.1 mm, respectively. The amount Fc was 0.9 mm without exception.

The potential difference (Vo−Vm) is selected to lie in a saturation range in which the amount Mt of toner to be transferred to the latent image of maximum potential remains substantially constant relative to the above potential difference. Assume, among the unfavorable conditions shown in FIGS. 23 and 25, the condition shown in FIG. 25 and in which the temperature is 35° C. and the humidity is 85% RH. In this condition, when the amounts mt1 and mt2 of toner conveyance by the rollers 36 and 38, respectively, are 0.2 mg/cm$^2$ and 1.4 mg/cm$^2$, the amount Mt of toner has a maximum value of 1.1 mg/cm$^2$. However, because the actual transfer ratio is 64 wt %, the toner is transferred to a paper in an amount of 0.7 mg/cm$^2$. When the paper carrying such an amount of toner was fixed, the image was measured to have an image density DI nearly equal to 1.3. Because this density DI is substantially equal to a value required of the maximum density on a paper, the above set values give the lower limits under a given condition.

On the other hand, assume that the ratio of the peripheral speed v1 of the first roller to the peripheral speed v2 of the second roller 38 and the difference between the bias voltages F1 and F2, i.e., Vd are maintained constant. Then, the amount mt2 assigned to the roller 38 is a monotonously incrementing function relative to the amount mt1 assigned to the roller 36.

Figure 27:
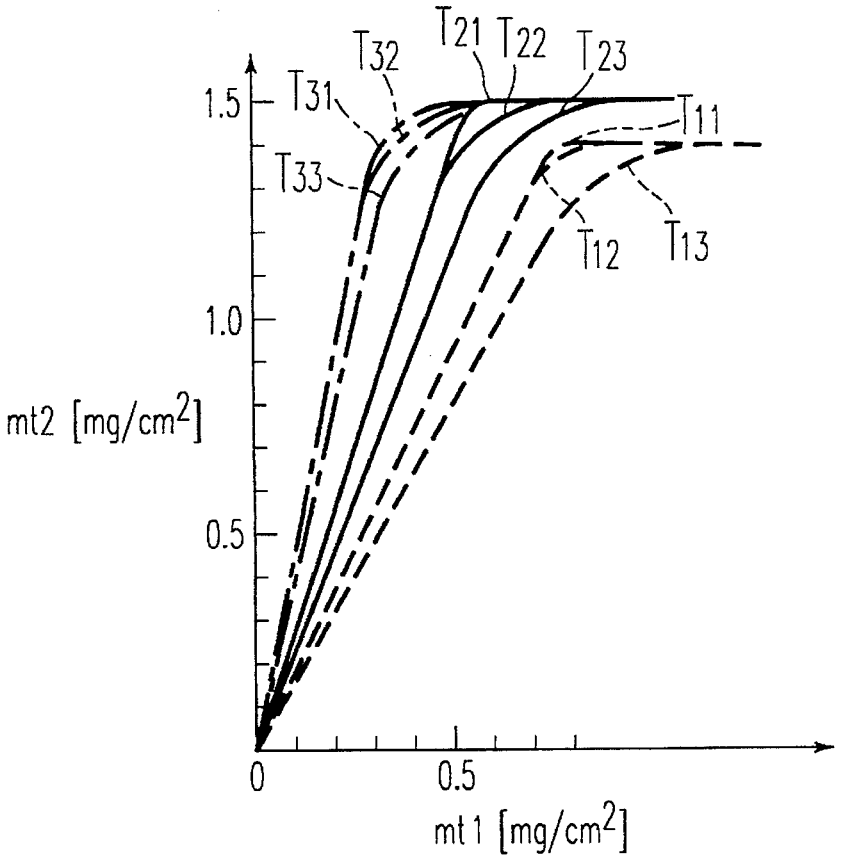
FIG. 27 shows a relation between the amount of toner to be conveyed by the first roller for a unit time and a unit area and the amount of toner to be conveyed by the second roller.

FIG. 27 shows a relation between the amounts mt1 and mt2 by using the speed ratio v1/v2 and voltage difference Vd as parameters. In curves Tij (i, j=1, 2, 3), the index i is representative of (vo−Vm); it is 1 when (Vo−Vm) is 400 V, 2 when (Vo−Vm) is 300 V, or 3 when (Vo−Vm) is 200 V. Likewise, the index j is representative of v1/v2 and is 1 when v1/v2 is 2, 2 when v1/v2 is 3, or 3 when v1/v2 is 5. Thus, they are proportional so long as m/2≦1.4 holds. The amount mt2 of 1.4 is also the lower limit which prevents the toner T from defacing an image when it is transferred from the roller 38 to the latent image of maximum potential and then fixed by the fixing unit.

Therefore, because mt1≦0.7 mg/cm$^2$ must also be satisfied when mt2 is 0.4, mt1=1.7 and mt2=1.4 also give lower limits. Combining these lower limits with the above limits, there is produced a relation of 1.4/0.7=2≦mt2/mt1≦1.4/0.2=7, i.e., 2≦mt2/mt1≦7. It is necessary that the ratio of the peripheral speed v2 of the roller 38 to the peripheral speed v0 of the drum 1 be greater than 1.0 but smaller than 1.4.

Some specific conditions found by changing the peripheral speeds v1 and v2 and bias voltages F1 and F2 will be described. First, when the bias voltages F1 and F2 were changed while the ratio v1/v2 was selected to be 2.75. In the embodiment, the voltages F1 and F2 were nearly equal to each other. When F1 and F2 were respectively −700 V and −400 V, i.e., when F2−F1=−400−(−700)=300 V, most of the toner T deposited on the roller 36 was transferred to the roller 38. When F1 and F2 were respectively 0 V and −400 V, i.e., when F2−F1=−400 −(0)=−400 V, most of the toner deposited on the roller 36 was left on the roller 36, and the toner T transferred to the roller 38 was returned to the roller 36. Further, when F1 and F2 both were in a floating state, the toner T deposited on the roller 36 was transferred to the roller 38, but partly remained on the roller 36.

Because the roller 36 bites into the roller 38, the contact pressure between the rollers 36 and 38 is determined by the hardness of the roller 36 and the amount of bite of the roller 36 into the roller 38. The contact pressure, in turn, determines how easy the toner T can pass through between the rollers 36 and 38. Whether or not the toner T is transferred from the roller 36 to the roller 38 depends on the orientation and intensity of the electric field between the rollers 36 and 38, the cognac pressure, the adhering force of the toner T, etc. When the roller 36 was rotated in the reverse direction, i.e., in such a manner as to follow the movement of the roller 38, and when F1 and F2 were respectively −800 V and −400 V, most of the toner T was transferred from the roller 36 to the roller 38.

In this manner, the embodiment allows the amount of toner to be conveyed by the roller 38 to the developing position to be controlled if the speed ratio v1/v2 and potential difference (F2−F1) are suitably selected. As a result, the amount mt1 and charge of the toner T to be conveyed by the roller 36, the speed ratio v2/vo, and the amount Mt of toner can each be controlled independently of the others.

As stated above, in the embodiment, the contact pressure between the blade 40 and the roller 36 and the projection of the blade edge 40*a* are controlled to maintain the amount mt1 of toner to be conveyed by the roller 36 greater than 0.2 mg/cm$^2$ but smaller than 0.7 mg/cm$^2$. This allows the device to form, despite the use of toner or single component developer, a toner image of sufficient density without defacing the image or causing the oppositely charged toner from appearing.

4TH EMBODIMENT

Figure 28:
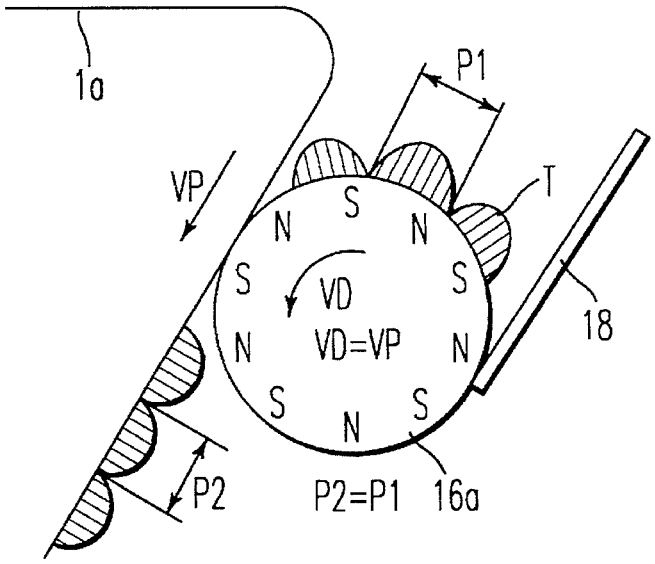
FIG. 28 PRIOR ART
FIGS. 28 and 29 are fragmentary sections showing a conventional developing device.

Referring again to FIG. 2, the problems to which this embodiment pertains will be described. As shown, in the developing device 10A, the belt 1*a* and magnetic hard roller 16*a* are rotated at the same peripheral speed in contact with each other. As shown in FIG. 28, when the periphery of the roller 16*a* is magnetized at an irregular pitch, the irregular pitch directly appears in the resulting image as a defect. To obviate: this occurrence, it has been customary to move the roller 16*a* at a three times to four times higher peripheral speed and minimize the magnetizing pitch as far as possible. However, as for the magnetizing pitch, an average flux cannot be formed on the surface of the roller 16*a* due to, for example, magnetic interference occurring at the time of magnetization. In addition, a predetermined flux is not attainable. When the peripheral speed of the roller 16*a* is increased to make up for the short toner supply, there arises other problems including the toner offset at the time of recording a black solid image or a halftone image, and jitter.

Figure 29:
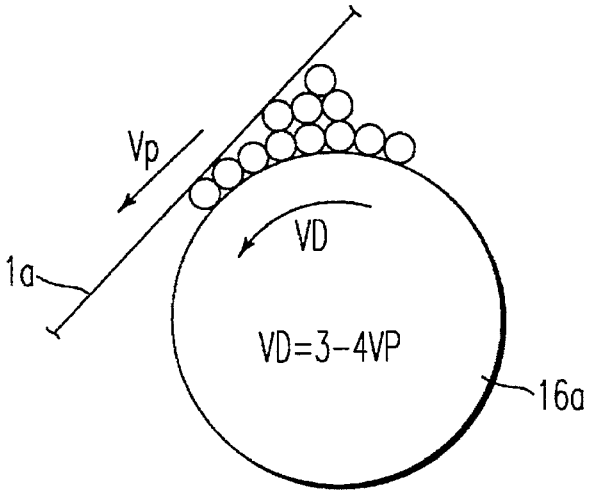
FIG. 29 PRIOR ART

FIG. 29 shows the accumulation of toner causative of the above-mentioned toner offset and occurring when the toner supply from the roller 16*a* to the belt 1*a* is excessive. Particularly, the toner excessively deposits on the trailing edge of a black solid image.

Figure 30:
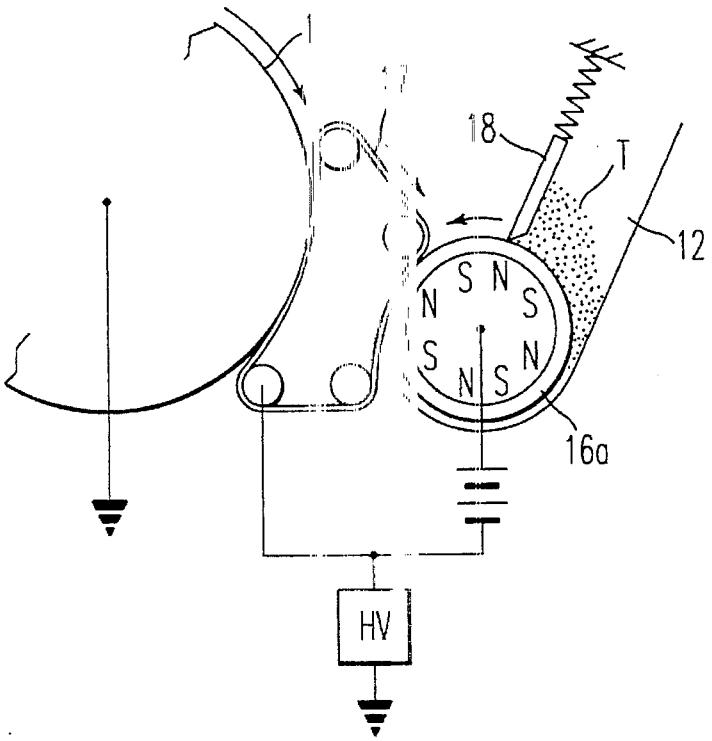
FIG. 30 PRIOR ART
FIG. 30 is a section of a conventional developing device having second conveying means implemented as a belt.

FIG. 30 shows a specific arrangement for eliminating the above problems. As shown, a conveyor belt 17 is interposed between the drum 1 and the roller 16*a*. This kind of arrangement was found to obviate magnetic interference at the time of magnetization as well as other undesirable occurrences. However, when the magnetizing pitch of the roller 16*a* is greater than 5 mm, the distance between the nearby poles is too great to form an intense flux circuit although the circuit may be formed. Moreover, the point intermediate between the nearby poles of the roller 16*a* is originally magnetically neutral and cannot magnetically retain the toner. Specifically, the toner particles at the intermediate point attract each other due to the flux connecting the nearby poles and merely cover the intermediate point. The flux, therefore, weakens with an increase in the distance between the adjoining poles, causing the toner to be displaced by a mechanical force. In this condition, when the toner is transferred from the roller 16*a*, contacting the belt 17 and moving at a higher speed than the belt 17, to the belt 17, the toner at the intermediate point is displaced due to the contact with the belt 17. Consequently, the toner layer on the belt 17 and, therefore, the resulting toner image becomes irregular in density.

Figure 31:
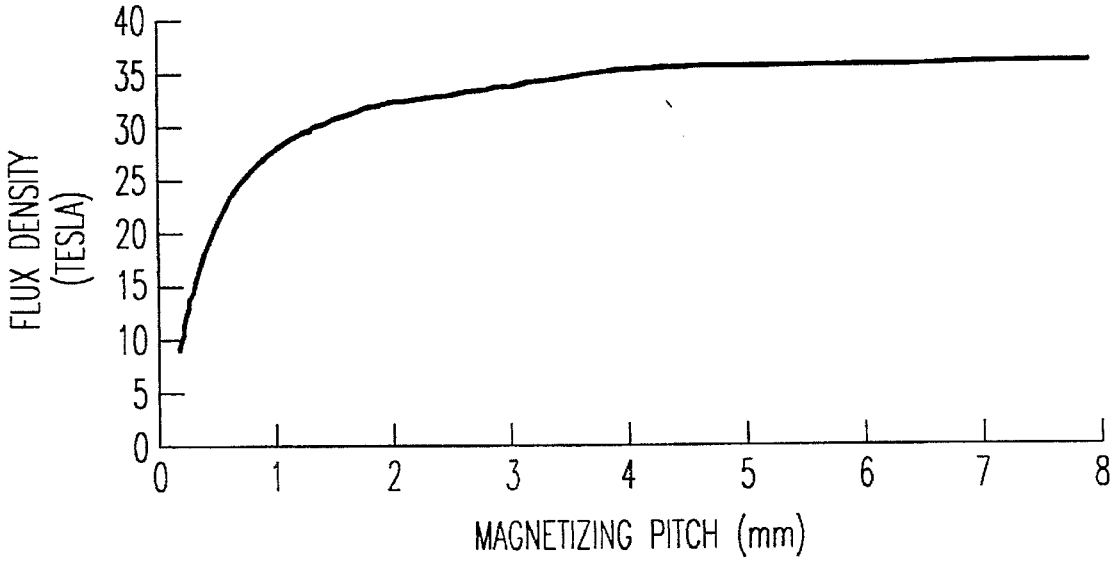
FIG. 31 shows a relation between the magnetizing pitch and the magnetic force and particular to a fourth embodiment of the present invention.

FIG. 31 shows a relation between the magnetizing pitch and the flux density (tesla), i.e., how the flux density changes when the magnetic field generating layer of the first roller 36 is magnetized in a given amount. As shown, the flux density sharply decreases when the magnetizing pitch decreases to below 1 mm; the amount of magnetization decreases with a decrease in the pitch. This is partly because the magnetism flies to nearby electrodes all the time of magnetization and partly because magnetic interference occurs between the electrodes. Hence, in the illustrative embodiment, the lower limit of the distance between the nearby electrodes should be about 1 mm.

Figure 32:
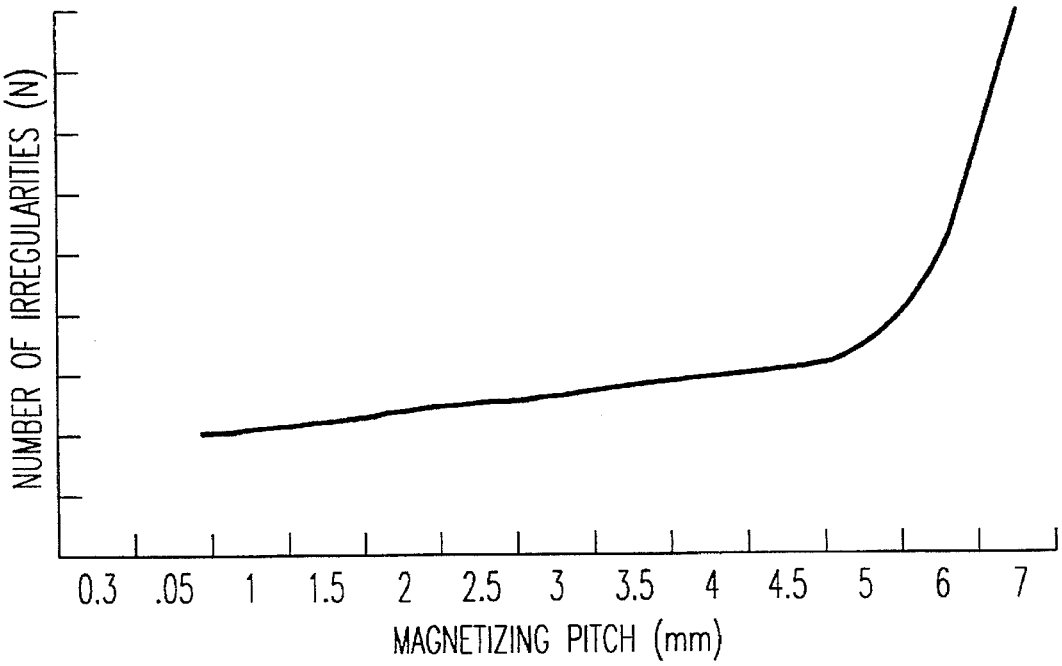
FIG. 32 is a graph showing a relation between the magnetizing pitch and the irregularity found in a toner layer.

FIG. 32 shows a relation between the magnetizing pitch and the number of irregular portions to occur in the toner layer. As shown, the number of irregular portions increases with an increase in magnetizing pitch and sharply increases when the pitch increases to above 5 mm. This brings about the problem discussed with reference to FIG. 30. In this embodiment, the upper limit of the magnetizing pitch is selected to be less than 5 mm.

Figure 33:
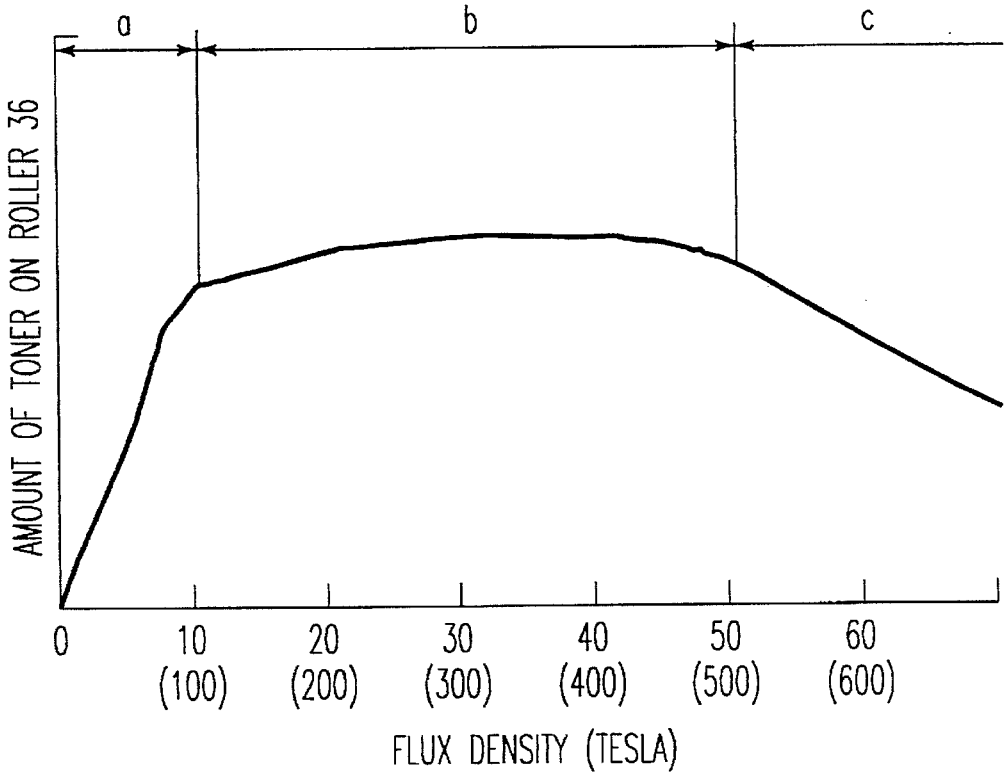
FIG. 33 shows a relation between the magnetic force and the amount of toner on the first roller.

FIG. 33 shows a relation between the flux density (tesla) and the amount of toner to deposit on the first roller 36. The toner on the roller 36 must form a thin layer evenly and stably. This solely depends on the degree, to which the roller 36 can magnetically retain the toner thereon. As shown in FIG. 33, when the flux density is less than 10 (range a), the amount of toner deposition is extremely unstable and sharply decreases. This is because the magnetic attraction of the roller 36 is not intense enough to retain the toner. On the other hand, when the flux density is higher than 50 (range b), the magnetic attraction and contact pressure acting between the roller 36 and the magnetic blade 40 increase. As a result, the restriction of the blade 40 overcomes the attraction of the roller 36, causing the amount of toner deposition on the roller 36 to decrease. It follows that the toner will stably deposit on the roller 36 if the flux density ranges from 10 to 50 (range c).

The blade 40 may be made of martensite-based stainless steel, if desired.

As stated above, the roller 36 has its magnetic field generating layer magnetized at a pitch of 1 mm to 5 mm. This ensures a predetermined flux density by obviating the interference between nearby electrodes at the time of magnetization. The toner can be transferred from the roller 36 to the roller 38 in such a manner as to form a uniform toner layer. Hence, the resulting image is free from an irregular density distribution, background contamination, and other defects.

Further, the magnetic force for causing the field generating layer of the roller 36 to retain a predetermined amount of toner is variable over a certain range. Hence, changes in surrounding conditions, including the temperature inside the apparatus and atmospheric temperature, can be sufficiently coped with. The aging of the roller 36 and blade 40 can also be coped with. This enhances the reliability of the developing device while ensuring attractive images.

The magnetic blade 40 is held in contact with the field generating layer of the roller 36 by an even pressure. This further promotes the deposition of the roller 36 in a thin uniform layer. In addition, the accuracy required of the blade 40 in position and part is eased while the cost of the device is reduced.

5TH EMBODIMENT

Figure 34:
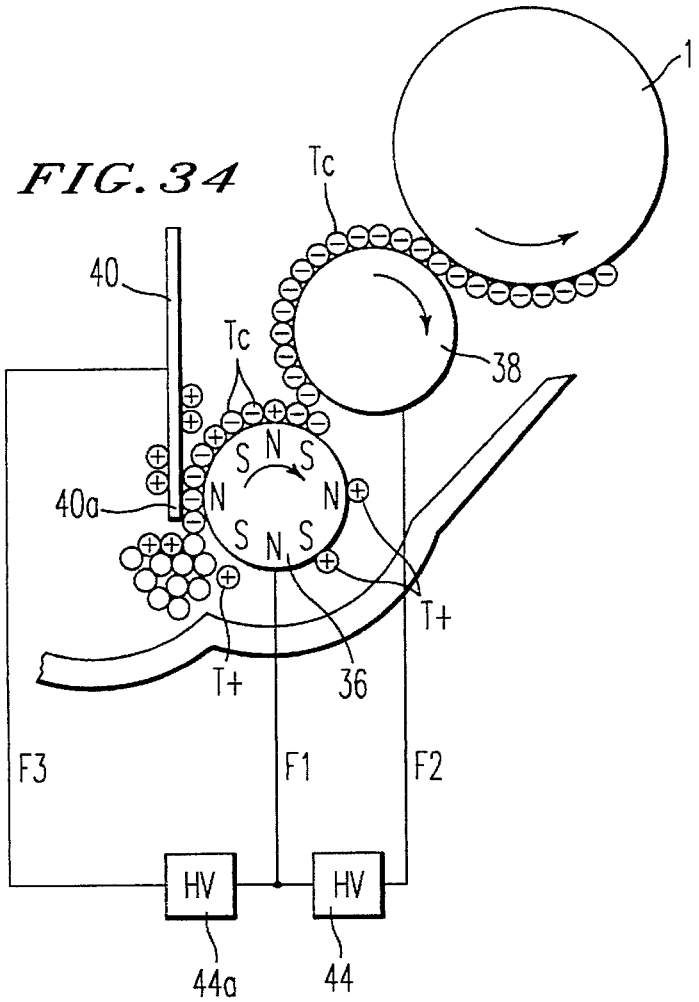
FIG. 34 is a section showing a fifth embodiment of the present invention.

As shown in FIG. 34, this embodiment eliminates the oppositely charged toner by applying a bias voltage F3 (V) to the blade 40. The bias voltage F3 is equal to or higher than the bias voltage F1 applied to the first roller 36. As shown, the bias voltages V1 and V3 are respectively applied from the power source 44 and a power source 44*a* to the roller 36 and the blade 40 in the above relation. In this condition, the oppositely charged toner T+ from the hopper 12 is electrostatically collected by the blade 40 and prevented from joining the toner layer on the roller 36. At the same time, the toner T+ attributable to the frictional charging of the blade 40 is collected by the blade 40. It is to be noted that the toner layer on the roller 36 is as thin as ten and some microns or less.

The blade 40 fails to collect some of the toner of opposite polarity T+ from the roller 36. This part of the toner T+ tends to move from the roller 36 to the roller 38 together with the toner of regular polarity Tc. However, because the bias voltages F1 and F2 are respectively applied to the rollers 36 and 38, only the toner Tc is transferred to the roller 38 due to the electric force generated by the voltages F1 and F2. The toner T+ is left on the roller 36 and then collected in the hopper 14 or again regulated by the blade 40 to the proper polarity by friction.

When the bias voltage (negative potential) F3 applied to the blade 40 is higher than the voltage V1 applied to the roller 36, a charge can be injected into the toner around the blade 40 to some degree. This also contributes to the elimination of the undesirable toner T+. The blade 40 may be implemented by a thin resilient sheet metal, e.g., a sheet of stainless steel (SUS301-CSP or 420J2 by way of example).

As stated above, this embodiment reduces the amount of toner of opposite polarity T+ and allows the blade 40 to collect it. Hence, a minimum amount of toner T+ is allowed to deposited on the roller 36. In addition, the toner T+ is prevented from being transferred from the roller 36 to the roller 38. This excludes the undesirable toner T+ in two consecutive stages and reduces it with high accuracy. The resulting images are free from background contamination, irregular density distribution, and other defects.

6TH EMBODIMENT

Figure 35:
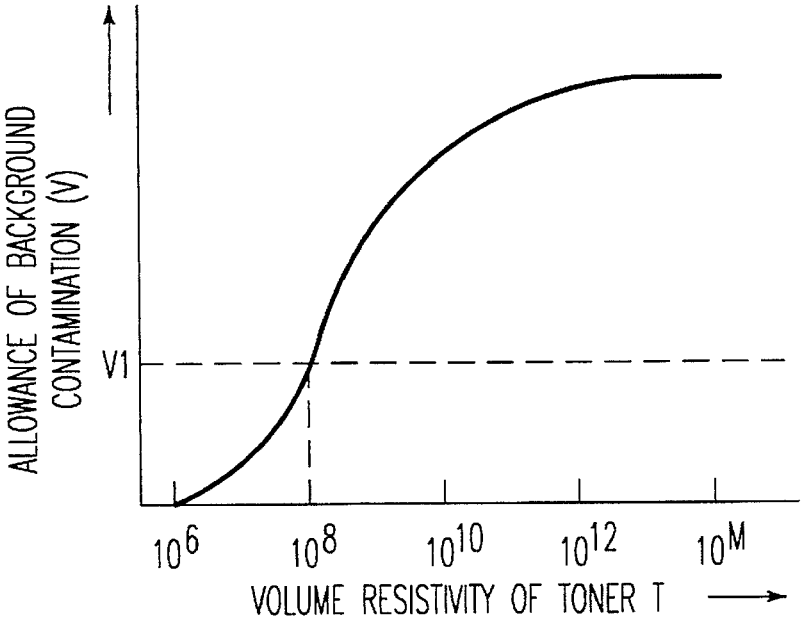
FIG. 35 shows a relation between the volume resistivity of toner and the allowance of background contamination, and representative of a sixth embodiment of the present invention.

This embodiment pertains to toner or single component type developer exclusively applicable to any one of the foregoing embodiments. FIG. 35 shows a relation between the volume resistivity of toner and the allowance of background contamination. The background contamination is attributable to the toner T transferred from the second roller 38 to the background whose potential is little different from the potential of the roller 38. Hence, as the potential difference causing the toner to start moving from the roller 38 to the drum 1 decreases, the contamination is more aggravated. The allowance of background contamination is represented by the minimum potential difference between the roller 38 and the drum 1 which maintains the contamination below a standard value. Specifically, if the allowance determined by the characteristic of the toner T is selected to be sufficiently great, the latent image can turn out a toner image with a minimum of background contamination without being affected by, for example, a decrease in the surface potential of the drum 1 due to aging.

As FIG. 35 indicates, the allowance increases with an increase in the volume resistivity of the toner T. Assuming that the practical allowable value of the contamination is $V_1$, then an allowance greater than the value $V_1$ is available if the toner T has a volume resistivity of higher than $10^8$ Ωcm. Generally, the volume resistivity of the toner T decreases with an increase in the content of magnetic powder dispersed in the toner particle. By limiting the content of the magnetic powder in the particle, it is possible to increase the volume resistivity to above $10^8$ Ωcm. The toner image developed by such toner T is stable and provided with clear background.

Figure 36:
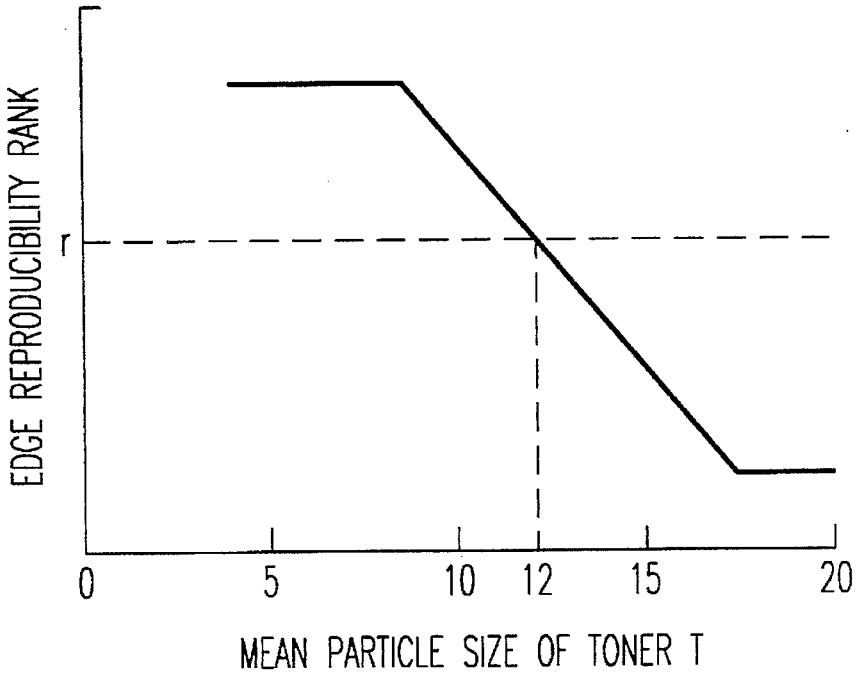
FIG. 36 shows a relation between the mean particle size of toner and the edge reproducibility rank particular to the sixth embodiment.

FIG. 36 shows a relation between the mean particle size of the toner T of the embodiment and the edge reproducibility rank as to a toner image. The edge reproducibility rank is the index representative of the edge reproducibility of a toner image; a higher rank indicates a sharper toner image. As shown, the reproducibility rank decreases with an increase in the mean particle size for the following reason. When the mean particle size increases, the packing density of toner T for a unit area decreases on the roller 38, and in addition the amount of toner deposition becomes uneven. The resulting toner image has its edges and thin lines blurred. Assuming that the practical allowable value of the reproducibility rank is r, a reproducibility rank higher than the value r is achievable if the toner T has a mean particle size of less than 12 μm. This kind of toner provides a toner image with sharp edges and sharp thin lines.

Figure 37:
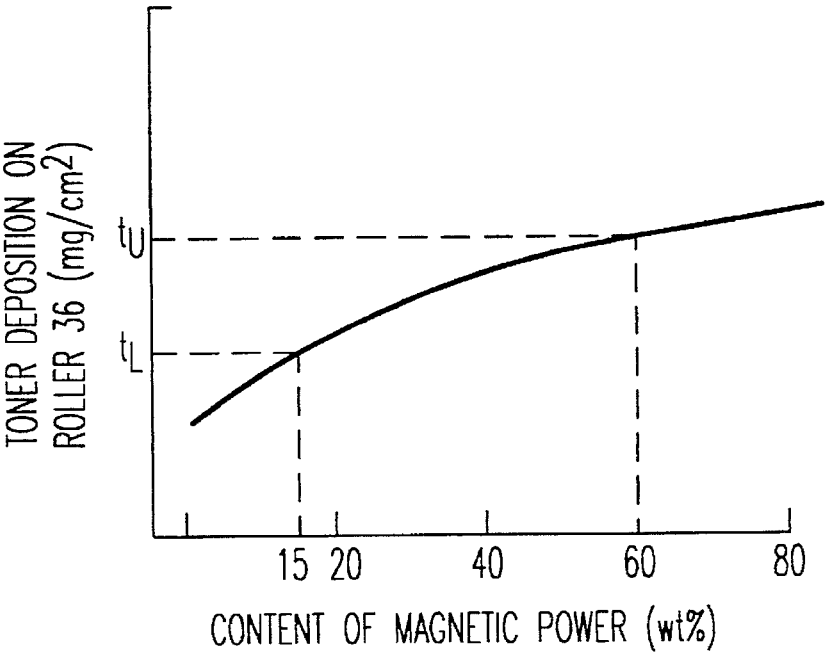
FIG. 37 shows a relation between the magnetic powder content of toner and the toner deposition on the first roller also particular to the sixth embodiment.
Figure 38:
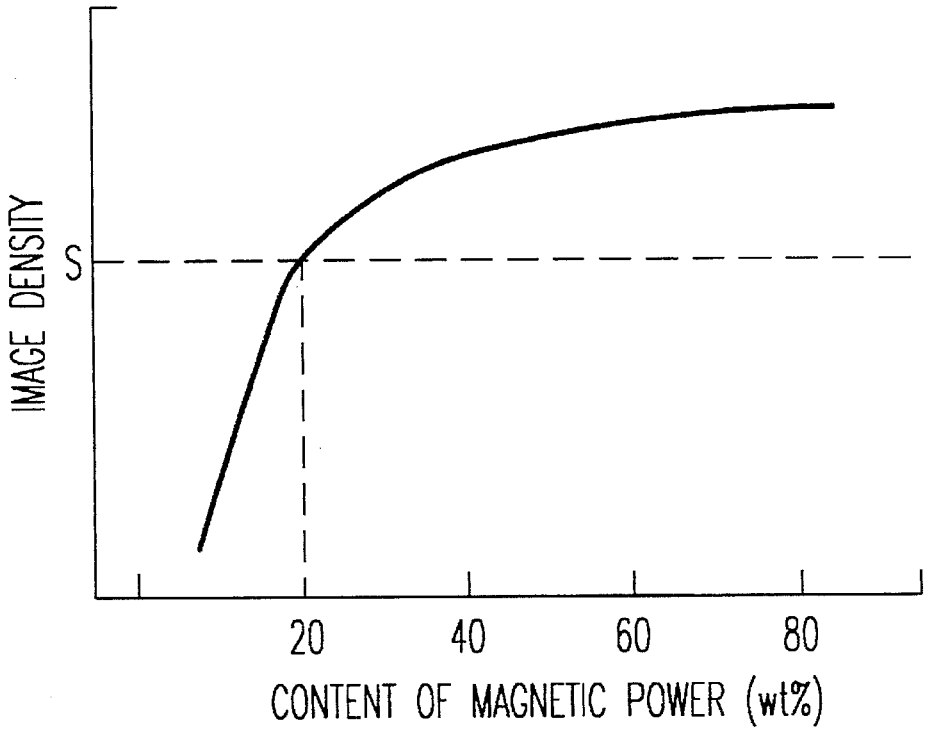
FIG. 38 shows a relation between the magnetic powder content and the density of a toner image.

FIG. 37 shows a relation between the content of magnetic powder of the toner particle and the amount of toner deposition on the roller 36. FIG. 38 shows a relation between the content of magnetic powder and the density of a toner image.

By limiting the content of magnetic powder, it is possible to implement a volume resistivity higher than $10^8$ Ωcm, as stated earlier. However, a decrease in the content of magnetic powder translates into a decrease in the amount of toner T to deposit on the roller 36. The amount of magnetization of the roller 36 may be increased to prevent the amount of toner T from decreasing on the roller 36. This, however, intensifies the magnetic attraction of the roller 36 acting on the blade 40 which is generally made of metal. The intense attraction increases the frictional resistance between the roller 36 and the blade 40, thereby increasing the torque for driving the roller 36 and accelerating the wear of the blade 40. Particularly, when the roller 36 is rotated in the counter direction (arrow A) relative to the blade 40, as shown in FIG. 3, the required torque and wear are aggravated. For this reason, the roller 36 should be magnetized only in a minimum necessary amount.

The relation between the content of magnetic powder and the amount of toner deposition on the roller 36 shown in FIG. 37 holds when the roller 36 is magnetized in the minimum necessary amount. It will be seen that the amount of toner deposition on the roller 36 increases with an increase in the content of magnetic powder. Assume that the adequate amount of toner deposition on the roller 36 has a lower limit $t_L$ and an upper limit $t_U$. Then, if the content of magnetic powder is greater than 15 wt %, but smaller than 60 wt %, an adequate amount of toner can be deposited on the roller 36. Further, when the content is less than 60 wt %, the toner can also be provided with the volume resistivity higher than $10^8$ Ωcm.

In the illustrative embodiment, the magnetic powder is implemented by ferrite and serves to color the toner T in black at the same time. Hence, a change in the content of the magnetic powder leads to a change in the density of the toner T.

FIG. 38 shows a relation between the density of a toner image and the content of the magnetic powder to hold when the amount of toner composition on the roller 36 is $t_L$. Assuming that the minimum necessary density of a toner image is s, then a latent image can be stably developed in a density higher than s if the content of magnetic powder is greater than 20 wt %.

Figure 39A:
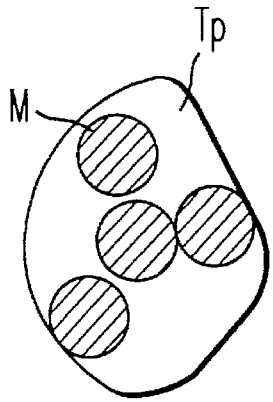
FIGS. 39A and 39B each shows a particular condition wherein the magnetic powder is dispersed in a single toner particle.
Figure 39B:
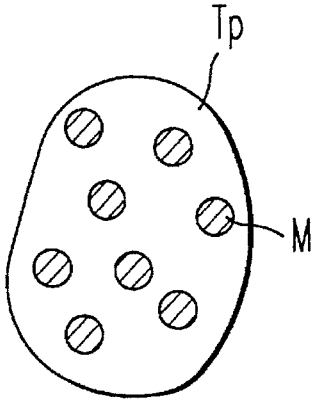

FIG. 39A shows a toner particle Tp in which magnetic powder M having a mean particle size of greater than 1 μm is dispersed. Likewise, FIG. 39B shows a toner particle Tp in which magnetic powder M having a mean particle size of smaller than 1 μm is dispersed. In the condition shown in FIG. 39A, the powder M is apt to be unevenly distributed. In the portion where the powder M gather, the resistance is noticeably lowered with the result that conduction occurs and prevents the particle TP frown retaining a charge. In addition, the uneven distribution of the powder M lowers the volume resistivity of the toner T and invites background contamination. By contrast, in the condition shown in FIG. 39B, the powder M is evenly distributed and sets up an even resistance distribution in the particle Tp. This allows the particle Tp to surely retain the expected charge and, in addition, prevents the volume resistivity from falling.

Figure 40:
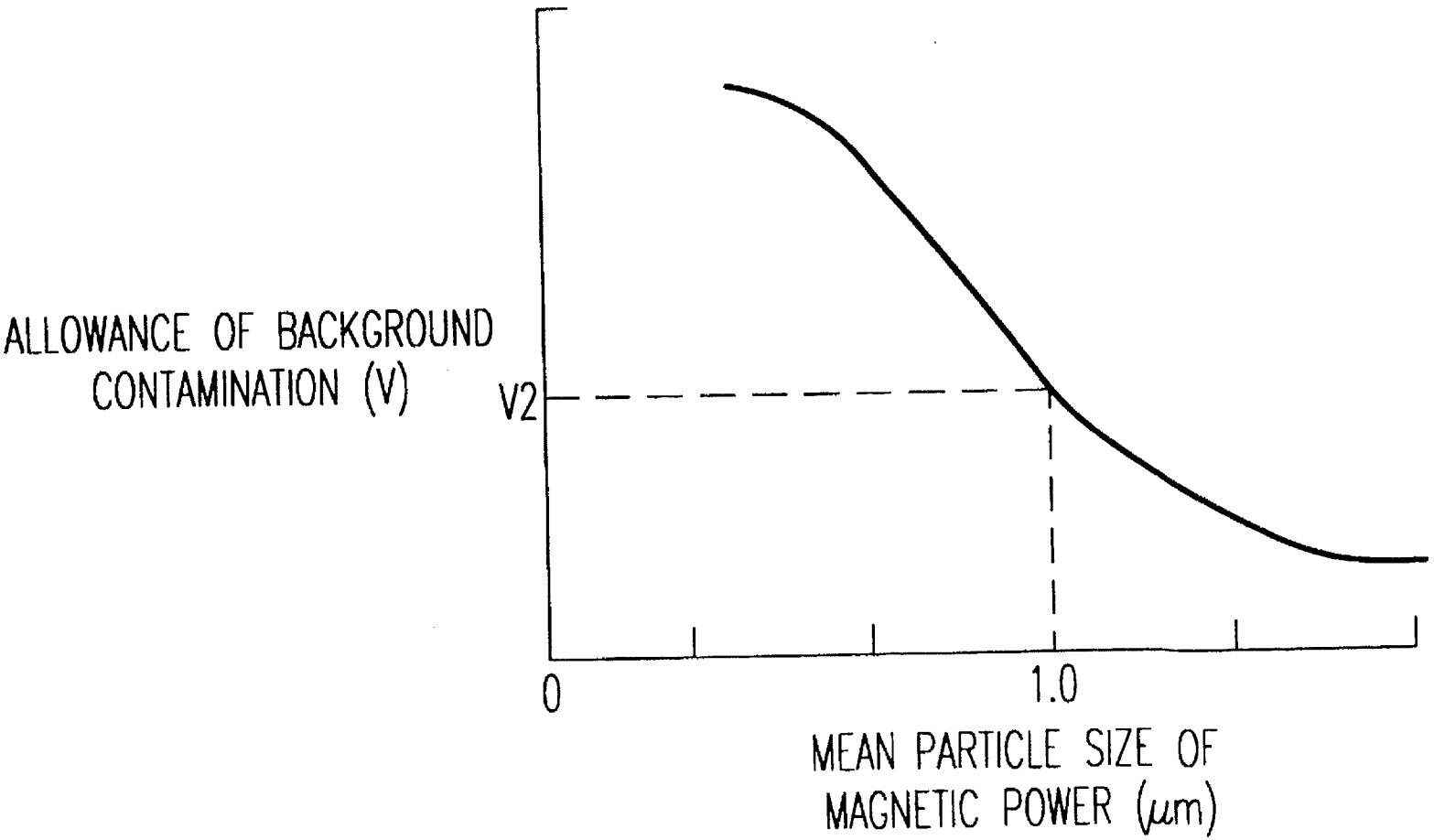
FIG. 40 is a graph representative of a relation between the mean particle size of the magnetic powder and and the allowance of background contamination.

FIG. 40 shows a relation between the mean particle size of the powder M and the allowance of background contamination to hold when the content of the powder M in the particle Tp is constant. As shown, assuming that the practical value of the allowance of background contamination is $v_2$, an allowance greater than $v_2$ is achievable if the mean particle size of the powder is less than 1 μm. When a latent image is developed by the toner T containing less than 1 μm of powder M in each particle, the resulting toner image is free from background contamination.

In summary, this embodiment provides a sufficient potential difference between the roller 36 and the drum 1 which causes the toner particles to start moving. Hence, the allowance of background contamination can be selected to be greater than the allowable value. A toner image produced by such toner is free from background contamination. Also, the toner is packed on the roller 38 in a sufficiently high density and in an even distribution, so that an edge reproducibility rank higher than an allowable value can be selected. This kind of toner is capable of rendering edges and thin lines sharp.

Further, the embodiment causes an adequate amount of toner to deposit on the roller 36 and provides the toner with an adequate black level. Hence, the toner T is allowed to form a layer on the roller 36 stably. As a result, the resulting toner image has high quality and adequate in density. Moreover, the magnetic powder is evenly distributed in each toner particle to set up an even resistance distribution. This, coupled with the fact that the volume resistivity of the toner is prevented from falling, allows the toner particles to surely retain the expected charge: and makes it possible to increase the allowance of background contamination to above the allowed value. This also successfully frees the resulting toner image from background contamination.

Various modifications will become possible for those skilled in the art after receiving the teachings of the present disclosure without departing from the scope thereof.

What is claimed is:

1. A developing device for an image forming apparatus and for developing a latent image electrostatically formed on an image carrier by toner, said device comprising:

first conveying means for conveying the toner deposited thereon;

regulating means for regulating an amount of the toner to be conveyed by said first toner conveying means while charging said toner by friction; and second conveying means contacting said first conveying means, and for receiving the charged toner from said first conveying means;

wherein said first toner conveying means comprises a magnetic field generating layer which is magnetized at a pitch ranging from 1 mm to 5 mm.

2. A device as claimed in claim 1, wherein said magnetic field generating layer has a flux density ranging from 10 tesla to 50 tesla.

3. A device as claimed in claim 1, wherein said regulating means comprises a magnetic member.

4. A device as claimed in claim 1, wherein said toner comprises one of single component type magnetic toner and single component type high resistance toner.

5. A device as claimed in claim 1, wherein said second conveying means comprises a dielectric layer.

6. A device as claimed in claim 1, further comprising bias applying means for applying a bias between said first and second conveying means whereby the charged toner is transferred from said first conveying means to said second conveying means.

7. A developing device for an image forming apparatus and for developing a latent image electrostatically formed on an image carrier by toner, said device comprising:

first conveying means for conveying the toner deposited thereon;

regulating means for regulating an amount of the toner to be conveyed by said first conveying means while charging said toner by friction;

second conveying means for receiving the charged toner from said first conveying means; and bias applying means for applying a bias between said first and second conveying means whereby the charged toner is transferred from said first conveying means to said second conveying means;

wherein said first conveying means comprises a magnetic field generating layer which is magnetized at a pitch ranging from 1 mm to 5 mm.

8. A developing device for an image forming apparatus and for developing a latent image electrostatically formed on an image carrier by toner, said device comprising:

a first roller for conveying the toner deposited thereon; a member for regulating an amount of the toner to be conveyed by said first roller while charging said toner by friction; and a second roller contacting said first roller, and for receiving the charged toner from said first roller;

wherein said first roller comprises a magnetic field generating layer which is magnetized at a pitch ranging from 1 mm to 5 mm.

9. A developing device for an image forming apparatus and for developing a latent image electrostatically formed on an image carrier by toner, said device comprising:

a first roller for conveying the toner deposited thereon; a member for regulating an amount of the toner to be conveyed by said first roller while charging said toner by friction;

a second roller for receiving the charged toner from said first roller; and a bias device for applying a bias between said first and second rollers whereby the charged toner is transferred from said first roller to said second roller;

wherein said first roller comprises a magnetic field generating layer which is magnetized at a pitch ranging from 1 mm to 5 mm.

* * * * *